US006060977A

United States Patent [19]

Yamamoto et al.

[11] Patent Number: 6,060,977

[45] Date of Patent: May 9, 2000

[54] CORE FOR USE IN INDUCTIVE ELEMENT, TRANSFORMER AND INDUCTOR

[75] Inventors: Yutaka Yamamoto; Takashi Hatanai; Akihiro Makino, all of Niigata-ken; Toshitaka Minamisawa, Nagano-ken, all of Japan

[73] Assignees: Alps Electric Co., Ltd.; Nagano Japan Radio Co., Ltd., both of Japan

[21] Appl. No.: 09/225,632

[22] Filed: Jan. 5, 1999

[30] Foreign Application Priority Data

Jan. 6, 1998 [JP] Japan ..... 10-001124
Jan. 27, 1998 [JP] Japan ..... 10-014576

[51] Int. Cl.[7] ..... H01F 5/00; H01F 27/28

[52] U.S. Cl. ..... 336/212; 336/200; 336/232

[58] Field of Search ..... 336/200, 223, 336/232, 212

[56] References Cited

U.S. PATENT DOCUMENTS 5,192,375 3/1993 Sawa et al. ..... 148/306
5,559,487 9/1996 Butcher et al. .
5,598,135 1/1997 Maeda et al. ..... 336/200
5,631,822 5/1997 Silberkleit et al. ..... 363/144
5,781,093 7/1998 Grandmont et al. ..... 336/232
5,850,336 12/1998 Nakajima ..... 363/39
5,939,966 8/1999 Ei ..... 336/223

FOREIGN PATENT DOCUMENTS 2409881 9/1975 Germany .
4-215412 8/1992 Japan .
9-120910 5/1997 Japan .

*Primary Examiner*—Lincoln Donovan
*Assistant Examiner*—Anh Mai
*Attorney, Agent, or Firm*—Brinks Hofer Gilson & Lione

[57] ABSTRACT

The present invention provides an inductor having a small core loss at a high frequency. The inductor includes a transformer that has a core formed of a base core and a cover core, and a conductive plate sandwiched between the base core and the cover core, as well as a conductive plate sandwiched between the base core and the cover core. The base core is composed of a Mn—Zn ferrite with a mean grain size of 5 $\mu$m or less. The transformer has a small core loss at a high frequency band without a decrease in power transmission efficiency.

25 Claims, 20 Drawing Sheets

CORE FOR USE IN INDUCTIVE ELEMENT, TRANSFORMER AND INDUCTOR

BACKGROUND OF THE INVENTION

1. Field of the Invention

The present invention relates to an inductive element for use in various electronic appliances, especially cores for use in inductive elements, and transformers and inductors comprising the core for use in the inductive element.

2. Description of the Related Art

Inductive elements such as transformers for increasing or decreasing electric voltages or for transforming the amount of electric current, or inductors that function as self-inductance have been indispensable to various kinds of electronic appliances.

Demands for compacting and thinning electronic appliances are increasing in recent years, posing problems to make the inductive elements to be integrated into these electronic appliances compact and thin.

Cores for the inductive elements having thinner shapes than conventional EI cores and toroidal cores are proposed as a mean for solving the problems of compacting and thinning the inductive elements described above.

The inductor making use of this core for use in the inductive elements will be described hereinafter referring to the drawings.

As shown in FIG. 20A, the inductor 1 is a type for packaging into a printed board, which is provided with a core 2 for the inductive head, printed board 3 and a lead wire 11.

A base plate 4 and a base core 6, comprising a magnetic substance provided with rectangular parallel-piped projections 5, 5 and so forth projected out of the top face of the base part 4 forming a matrix with three columns and rows aligned by a given distance apart, are provided on the core 2 for the inductive element. The rectangular parallel-piped projections 5, 5 and so forth are formed to have the same height with each other.

Grooves 10 divided by the side faces 13 and 13 of the projections 5 and 5 of two rectangular parallel-piped projections and the base plate 4 are provided on the base core 6 as shown in FIG. 20A. In the configuration shown in FIG. 20, the numbers of the Grooves 10 accounts for 12 since there are nine projections 5, 5 and so forth.

A cover core 7 comprising a plate of magnetic substance is provided on the core 2 for the inductive element.

The printed board 3 is composed of an insulation plate 3*a* such as a glass-epoxy plate, holes 12, 12 and so forth for allowing the rectangular parallel-piped projections 5, 5 and so forth on the base core 6 to penetrate are drilled through the insulation plate 3*a*.

A lead wire 11 and the printed board 3 are disposed so as to be sandwiched between the base core 6 and cover core 7.

In more detail, the lead wire 11 comprising a wire material of a metal is mounted on the base core 6 so as to crawl through all the twelve grooves 10, 10 and so forth. Both ends 11*a* and 11 *a* of the lead wire 11 is joined to the other electronic circuits.

Then, The printed board 3 is mounted on the top face of the base core 6 so that the rectangular parallel-piped projections 5, 5 and so forth are allowed to penetrate through the holes 12, 12 and so forth.

Finally, the cover core 7 is mounted on the printed board 3 by adhering the top faces 8, 8 and so forth of the rectangular parallel-piped projections 5, 5 and so forth penetrating through the printed board 3 with the bottom face 9 of the cover core 7.

As shown in FIG. 20B, mutually independent closed magnetic circuit for allowing a magnetic flux generated by the voltage impressed on the conductor 11 is formed in the inductor 1 described above with the rectangular parallel-piped projections 5 and 5, the base plate 4 and the cover core 7. These closed magnetic circuits are referred to unit core 15, 15 and so forth (the inside surrounded by dotted lines). The numbers of the unit cores 15 are twelve since twelve grooves 10 are provided.

Therefore, the core 2 for the inductive element assumes a construction in which a plurality of unit cores 15 are disposed on the same plane.

The lead wire 11 serves as an inductive element that induces inductance, which is determined by the cross sectional area of the magnetic circuit of the unit core 15 and magnetic permeability of the magnetic substance, when it passes through the unit core 15. When the lead wire 11 passes through a plurality of the unit cores 15, 15 and so forth, the inductance value obtained is proportionally increased.

Accordingly, the lead wire 11 may be allowed to pass through a lot of unit cores 15, 15 and so forth when a large inductance value is necessary.

When two strings of lead wires 11 pass through the grooves 10, 10 and so forth of the core 2 for the inductive elements, it is also possible to form a transformer in which one string of the lead wire 11 serves as a primary coil and the other string of the lead wire serves as a secondary coil.

According to the core 2 for the inductive element, the dimension of the core can be made thin since the unit cores 15 are disposed on one face of the base core 6.

The numbers of the unit cores 15 can be readily increased or decreased by increasing or decreasing the numbers of the rectangular parallel-piped projections 5, 5 and so forth.

Furthermore, the core for the inductive head may be used for a transformer by adjusting the number of the lead wires.

The dimension of the inductor 1 as hitherto described can be made thin since it is provided with the core 2 for the inductive element.

A prescribed level of inductance can be induced in the inductor 1 described above with one or more of the unit cores 15 provided on the core 2 for the inductive element and the lead wire 11 passing through these core units 15.

By adjusting the numbers of the unit cores 15 through which the lead wire 11 passes, or by allowing the lead wire 11 to pass through a part of the core units 15, the inductance level of the foregoing inductor 1 can be readily adjusted.

Ferrite materials such as a Mn—Zn ferrite and a Ni—Zn ferrite or metallic materials such as permalloy, sendust and metallic materials such as an amorphous metal alloy have been used for the materials of the core 2 for the inductive element.

However, there remained a problem in the inductor 1 produced by using conventional ferrite materials that core loss of the core 2 of the inductive element becomes large when an alternate current in a high frequency band is impressed.

SUMMARY OF THE INVENTION

Accordingly, the object of the present invention, carried out for solving the problems as described above, is to provide a core for use in the inductive element having a small core loss at a high frequency band and being able to make the shape thin, along with providing a transformer with a small core loss at a high frequency band without decreasing power transmittance performance besides providing an inductor with less core loss at a high frequency band.

For attaining the foregoing objects, the constructions as will be described hereinafter are set forth in the present invention.

In a first aspect, the present invention provides a core for an inductive element provided with a base core and a cover core made of a Mn—Zn ferrite with a mean grain size of 5 μm or less obtained by baking after molding a starting powder material of the Mn—Zn ferrite formed into grains, wherein a plurality of projections are aligned approximately in parallel relation with each other with a given distance apart among them on one face of at least one of the base core and the cover core, and the base core is overlaid with the cover via the projections, one or more of unit cores being formed of the base core, two or more of the projections and the cover core.

The present invention also provides a core for the inductive element provided with a base core and a cover core made of a Mn—Zn ferrite with a mean grain size of 5 μm or less obtained by baking after molding a starting powder material of the Mn—Zn ferrite formed into grains, wherein a projection group of a rectangle comprising a plurality of projections is aligned approximately in parallel relation with each other with a given distance apart among them on one face of at least one of the base core and the cover core, and the base core is overlaid with the cover core via the projections, one or more of unit cores being formed of the base core, two or more of the projections and the cover core.

In accordance with the core for the inductive element of the present invention as described above, the ratio between the area S1 of one face of the base core or the cover core and the total area S2 of the top faces of the projections satisfies the relation of $1.1 \leqq S1/S2 \leqq 5.5$.

In accordance with the core for the inductive element of the present invention as described above, the Mn—Zn ferrite also has the following composition represented by mol %:

$Fe_2O_3$: 52 to 55

ZnO: 5 to 20

MnO: 25 to 40

In accordance with the core for the inductive element of the present invention as described above, the Mn—Zn ferrite additionally has a relative density of 97% or more, a mean grain size of 1.3 to 3.0 μm and a performance coefficient of 50 to 300 at 1 MHz, the frequency range where a maximum performance coefficient is displayed being preferably from 0.2 through 2 MHz.

The transformer according to the present invention is provided with a core for the inductive element, an insulation plate through which holes for allowing the projections of the base core to penetrate are drilled and a conductive plate for the transformer provided with a primary conductive member and a secondary conductive member formed on one face or on both faces of the insulation plate.

According to the transformer of the present invention as described above, the conductive plate for the transformer is constituted by disposing the primary conductive member and the secondary conductive member forming a zigzag route along the holes described above, wherein the conductive plate for the transformer is disposed so as to be sandwiched between the base core and the cover core by allowing the projections to penetrate through the holes, the primary conductive member and the secondary conductive member being disposed within the unit core.

The inductor according to the present invention is provided with the core for the inductive element as described above, an insulation plate through which holes for allowing the projections of the base core to penetrate are drilled and a conductive plate for the inductor provided with conductive members formed on one face or on both faces of the insulation plate.

According to the inductor of the present invention as described above, the conductive plate for the inductor is constituted by disposing the conductive members forming a zigzag route along the holes, wherein the conductive plate for the inductor is disposed so as to be sandwiched between the base core and cover core by allowing the projections to be penetrated through the holes, the conductive members being disposed within the unit cores.

The core for the inductive element is constituted by being provided with a base core, made of a Mn—Zn ferrite with a mean grain size of 5 μm or less obtained by baking after molding a starting powder material of the Mn—Zn ferrite formed into grains and being provided with a plate of a base part and two or more of pillar-shaped projections projecting out of one face of the base plate, and a plate of a cover part, wherein the base core is integrated with the cover core by adhering the top faces of the pillar-shaped projections of the base core with the bottom face of the cover core, one or more of unit cores being formed of the base plate, two or more of the pillar-shaped projections and the cover core.

It is more preferable for the core for the inductive element according to the present invention as described above that the ratio between the area S1 of one face of the base and the total area of the top face of the pillar-shaped projections satisfies the relation of $2 \leqq S'1/S'2 \leqq 16$.

It is more preferable in the core for the inductive element according to claim 3 as described above that the Mn—Zn ferrite also has the following composition represented by mol %:

$Fe_2O_3$: 52 to 55

ZnO: 5 to 20

MnO: 25 to 40

It is more preferable in accordance with the core for the inductive element of the present invention as described above that the Mn—Zn ferrite additionally has a relative density of 97% or more, a mean grain size of 1.3 to 3.0 μm and a performance coefficient of 50 to 300 at 1 MHz, the frequency range where a maximum performance coefficient is displayed being preferably from 0.2 through 2 MHz.

The transformer according to the present invention is provided with the core for the inductive element hitherto described, an insulation plate through which holes for allowing the pillar-shaped projections of the base core to penetrate are drilled, and the primary conductive member and the secondary conductive member formed on one face or both faces of the insulation plate.

According to the transformer as described above, the conductive plate for the transformer is constituted by disposing the primary conductive member and the secondary conductive member forming a zigzag route along the holes, the current flow direction of the secondary conductive member being disposed so as to cross with the current flow direction of the primary conductive member at a right angle, and the conductive plate for the transformer is disposed so as to be sandwiched between the base core and the cover core by allowing the pillar-shaped projections to penetrate through the holes, the primary conductive member and the secondary conductive member being disposed within the unit cores.

According to the transformer of the present invention as described above, at least two secondary conductive members are formed on the conductive plate for the transformer.

The inductor according to the present invention is provided with the core as hitherto described, an insulation plate through which holes for allowing the pillar-shaped projections of the base core to penetrate are drilled, and conductive members formed on one face or on both faces of the insulation plate.

According to the inductor of the present invention as described above, the conductive plate for the inductor is constituted by disposing the conductive member forming a zigzag route along the holes, wherein the conductive plate for the conductor is disposed so as to be sandwiched between the base core and the cover core by allowing the pillar-shaped projections to penetrate through the holes, the conductive member being disposed within the unit cores.

DESCRIPTION OF THE PREFERRED EMBODIMENT

Figure 1A:
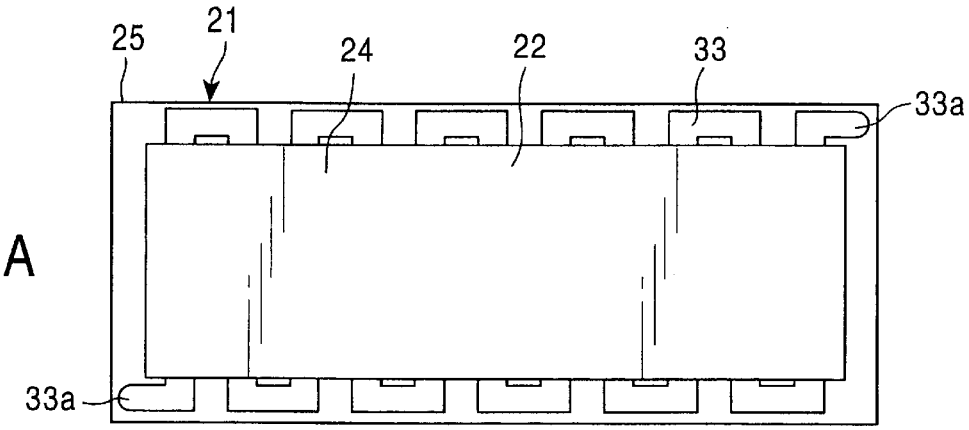
FIG. 1 is a drawing showing the transformer provided with the core for the inductive element according to the embodiment of the present invention, wherein A is a plane view, B is a side view, C is a front view and D is a rear view.

The first embodiment of the present invention will be described hereinafter referring to the drawings.

As shown in FIG. 1A to FIG. 1D, the transformer 21 is composed of a base core 23 comprising a Mn—Zn ferrite as a core 22 for the inductive element, a cover core 24 comprising a Mn—Zn ferrite and a conductive plate 25 for the transformer.

Figure 1B:
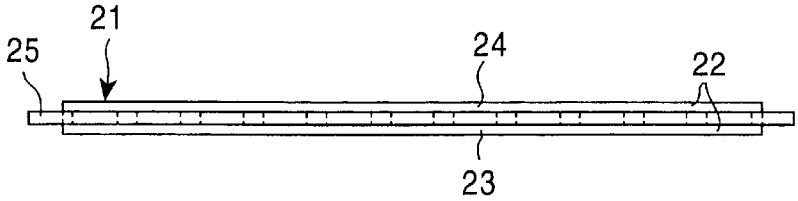
Figure 1C:
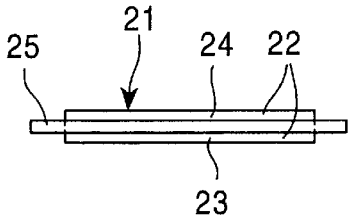
Figure 1D:
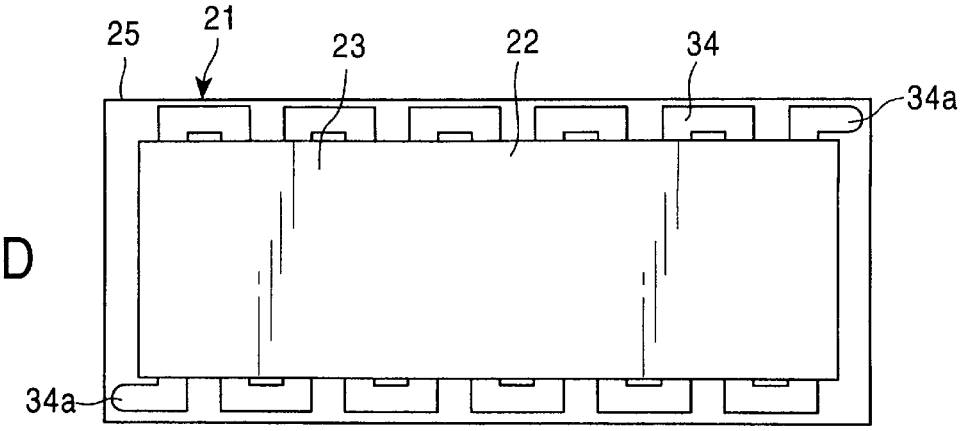
Figure 2A:
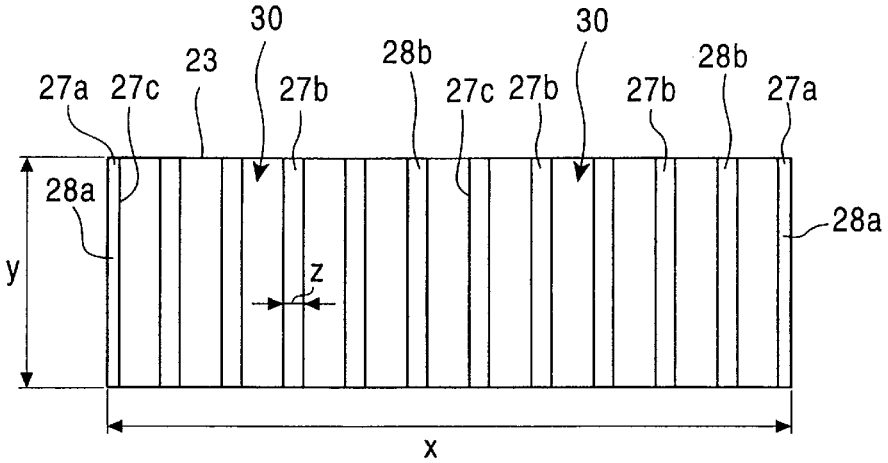
FIG. 2 is a drawing showing the base core of the core for the inductive element according to the embodiment of the present invention, wherein A is a plane view, B is a side view and C is a front view.
Figure 2B:
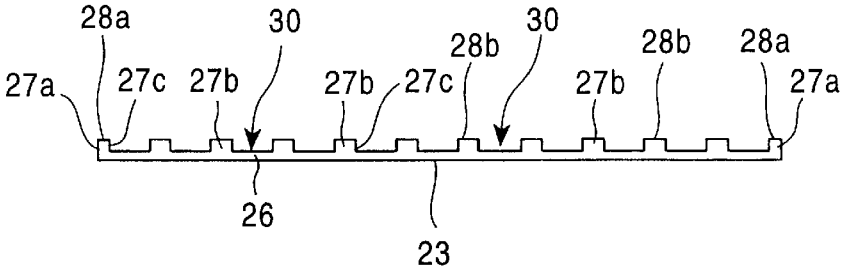
Figure 2C:
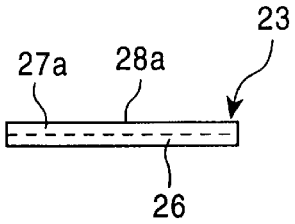

As shown in FIG. 2A to FIG. 2C, the base core 23 is composed of a rectangular plate of a base part 26, two projection 27*a* or projections 27*b* and so forth disposed by being elongated along the transverse direction of the base plate 26, the projections 27*a*, 27*b* and so forth and 27*a* being aligned in parallel relation with each other with approximately a constant distance apart among them. The shapes of the projections 27*a*, 27*b* and so forth and 27*a* assume, as shown in FIG. 1 for example, a rectangular parallel-pipe.

The top face 28*a* of respective two projections 27*a* and 27*a* located at both ends along the longitudinal direction of the base plate 26 is formed so as to have an area two-halves as small as the area of respective top faces 28*b*, 28*b* and so forth of the remaining projections 27*b*, 27*b* and so forth.

In addition, the heights of the projections 27*a*, 27*b* and so forth and 27*a* are adjusted to be the same with each other. Although it is not preferable that the heights are not the same with each other since all the projections 27*a*, 27*b* and so forth and 27*a* can not be joined with the bottom face 29 of the cover core 24, convex portions may be provided on the cover core 24 side to make a contact with the projections 27*a*, 27*b* and so forth and 27*a* for aligning the base plate 26 and the cover core 24 in parallel relation with each other.

Grooves 30, 30 and so forth, divided by the side faces 27*c* and 27*c* of the projections 27*a* and 27*b*, or projections 27*b* and 27*b*, and the base plate 26, are provided on the base core 23. Since twelve projections 27*a*, 27*b* and so forth and 27*a* are provided in this drawing, there are eleven grooves 30, 30 and so forth between the two adjoining projections among the projections 27*a*, 27*b* and so forth and 27*a*. Individual grooves 30, 30 and so forth have the same width with each other.

As shown in FIG. 2A, provided that the edge length of the base core 23 along the longitudinal direction be x and the remaining edge length be y, then the area S1 of the base plate 26 satisfied the relation of S1=xy.

The total area of the top faces 28*a*, 28*b* and so forth and 28*a* is, provided that the width of the top face 28*b* of the projection 27*b* be z, represented by S2=10yz+2y(½ z) =11yz since there are ten projections 27*b* and two projections 27*a*.

It is preferable that the ratio between S1 and S2 satisfies the relation of $1.1 \leqq S1/S2 \leqq 5.5$.

It is not preferable that S1/S2 is smaller than 1.1 since the widths of respective grooves 30, 30 and so forth becomes extremely small. It is also not preferable that S1/S2 is larger than 5.5 since the cross sectional area of the closed magnetic circuit of the projections 28*a*, 28*b* and so forth and 28*a* becomes extremely small.

Figure 6A:
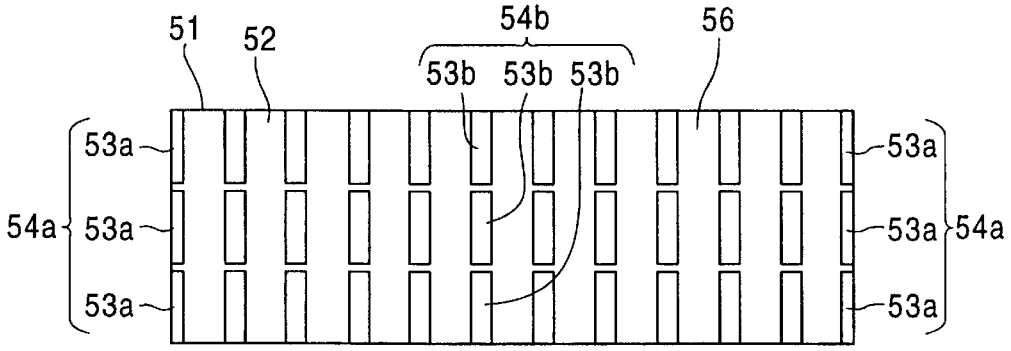
FIG. 6 is a drawing showing the base core of the core for the inductive element according to the embodiment of the present invention, wherein A is a plane view, B is a side view and C is a front view.
Figure 6B:
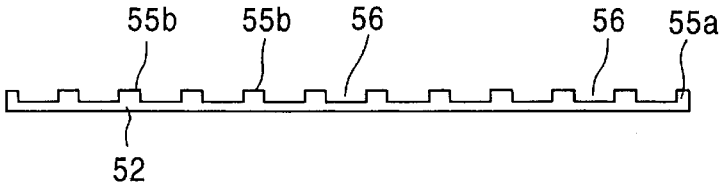
Figure 6C:
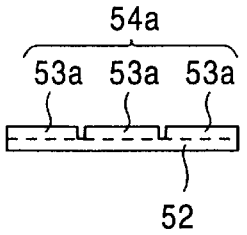
Figure 7A:
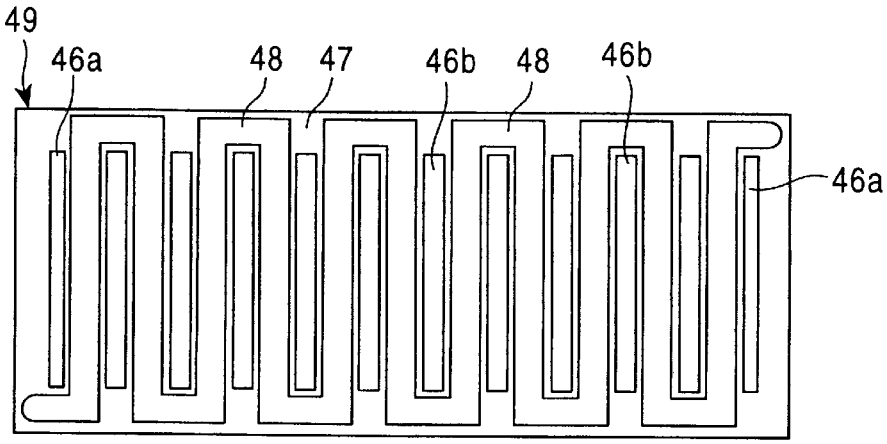
FIG. 7 is a drawing showing the conductive plate for the inductor of the inductor provided with the core for the inductive element according to the embodiment of the present invention, wherein A is a plane view, B is a side view, C is a front view and D is a rear view.
Figure 7B:
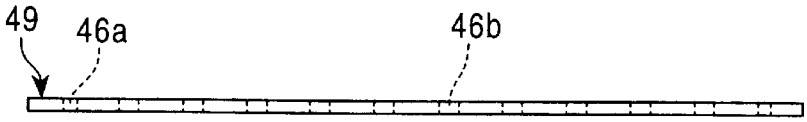
Figure 7C:
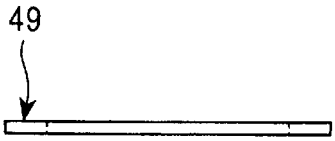
Figure 7D:
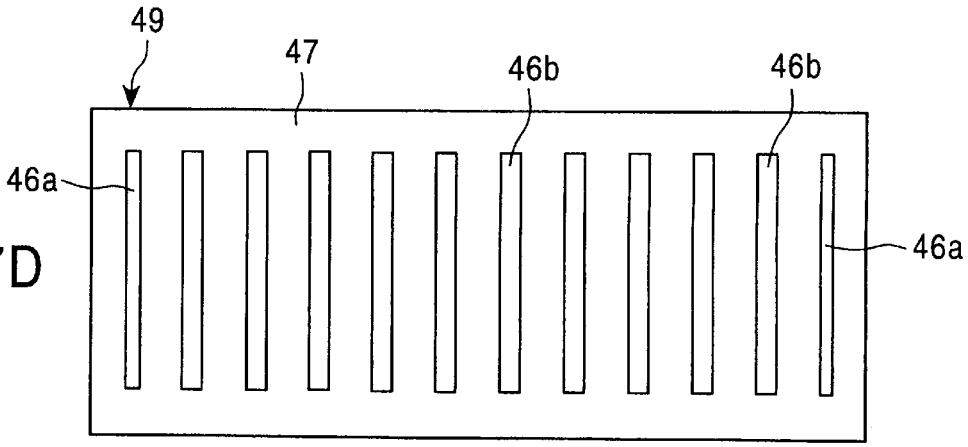

FIG. 6 shows a different base core 51. This base core 51 is composed of a rectangular plate of the base portion 52 and a group of projections 54*a*, 54*b* and so forth and 54*a* comprising a plurality of projections 53*a* , 53*b* and so forth and 53*a* disposed by being elongated along the transverse direction of the base part 52, the projections 54*a*, 54*b* and so forth and 54*a* in the group are aligned in parallel relation with each other with approximately a constant distance apart among them.

The projections 53*a*, 53*b* and so forth and 53*a* assume a rectangular shape as shown, for example, in FIG. 6.

The area of the top face 55*a* of the projections 53*a* and so forth located at both end along the longitudinal direction of the base plate 52 is formed so as to have an area approximately by one-half as mall as the area of the top face 55*b* of the other projections 53*b* and so forth.

In addition, the heights of the projections 53*a*, 53*b* and so forth and 53*a* are adjusted to be the same with each other. Although it is not preferable that the heights are not the same with each other since all the projections 27*a*, 27*b* and so forth and 27*a* can not be joined with the bottom face 29 of the cover core 24 in adhering with the cover core to be described hereinafter, convex portions may be provided on the cover core 24 side to make a contact with the projections 27*a*, 27*b* and so forth and 27*a* for aligning the base plate 26 and the cover core 24 in parallel relation with each other.

Grooves 56, 56 and so forth are provided on the base core 51. Since twelve projections 54*a*, 54*b* and so forth and 54*a* are provided in the projection group in this drawing, there are eleven grooves 56, 56 and so forth between respective two adjacent projections among the projection group 54*a*, 54*b* and so forth and 54*a*. The width of respective grooves 56, 56 and so forth are the same with each other.

Figure 3A:
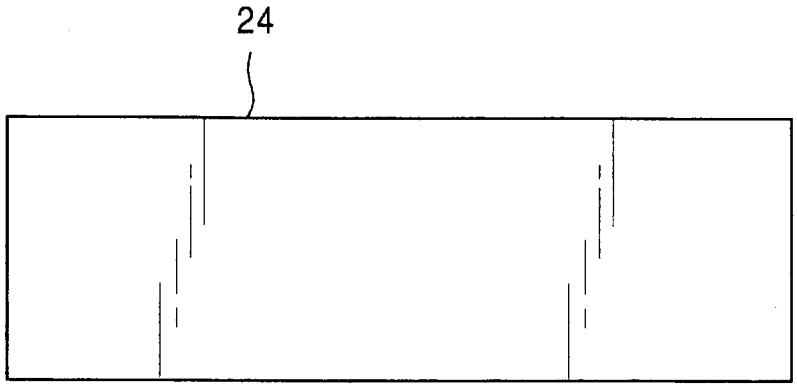
FIG. 3 is a drawing showing the cover core of the core for the inductive element according to the embodiment of the present invention, wherein A is a plane view, B is a side view and C is a front view.
Figure 3B:
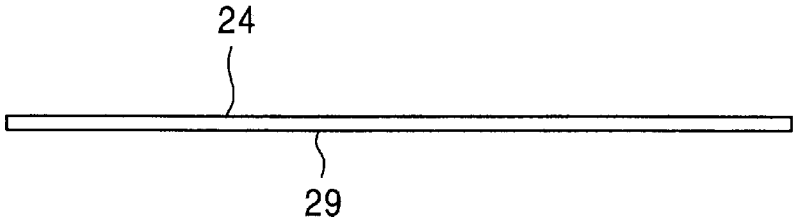
Figure 3C:
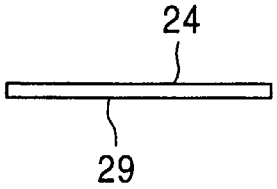

The cover core 24 of the core 22 for the inductive element assumes a plate as shown in FIG. 3A to FIG. 3C.

As shown in FIG. 5A to FIG. 5D, an insulation plate 32 through which slender holes for allowing the projections 27*a*, 27*b* and so forth and 27*a* of the base core 23 to penetrate are drilled, a primary conductive member 33 formed on one face of the insulation plate 32 and a secondary conductive member 34 formed on the other face are provided on the conductive plate 25 for the transformer.

The slender holes 31*a*, 31*b* and so forth and 31*a* are drilled so that their dimensions and positions correspond to those of the top faces 28*a*, 28*b* and so forth and 28*a* of the projections 27*a*, 27*b* and so forth and 27*a*.

The primary conductive member 33 and secondary conductive member 34 are disposed forming a zigzag route along the peripheries of the slender holes 31*a*, 31*b* and so forth and 31*a*.

An insulation layer (not shown in the drawing) is additionally formed on the primary conductive member 33 and secondary conductive member 34 in order to maintain insulation between the cores 32 for the inductive element and the conductive bodies.

The primary conductive member 33 and secondary conductive member 34 are connected to external lead wires (not shown in the drawing) via the primary terminal 33*a* and secondary terminal 34*a*.

The insulation plate 32 is made of a material having a high insulation property such as a glass-epoxy material, paper-epoxy material and phenol resin.

While the primary conductive member 33 and secondary conductive member 34 are made of a copper foil formed on the insulation plate 32 in the drawing, the material is not limited thereto but a copper plate or a wire materials of copper and the like are favorably selected and used depending on the power to be impressed on the transformer.

The insulation layer on which the primary conductive member 33 and secondary conductive member 34 are formed is made of a glass-epoxy material, paper-epoxy material, phenol resin and the like.

The conductive plate 25 for the transformer having such construction is readily produce by, for example, subjecting a multi-layer printed board to pattern etching of the primary conductive member 33 and secondary conductive member 34 followed by drilling the slender holes 31*a*, 31*b* and so forth and 31*a*.

As shown in FIG. 1A and FIG. 1B, the conductive plate 25 for the transformer is disposed so as to be sandwiched between the base core 23 and cover core 24.

The conductive plate 25 for the transformer is at first mounted on the top face of the base core 23 by allowing the projections 27*a*, 27*b* and so forth and 27*a* to penetrate through the slender holes 31*a*, 31*b* and so forth and 31*a*.

Then, the cover core 24 is mounted on the conductive plate 25 for the transformer by adhering its bottom face 29 with the top faces 28*a*, 28*b* and so forth and 28*a* of the projections 27*a*, 27*b* and so forth and 27*a*.

The conductive plate 25 for the transformer is disposed so as to be sandwiched between the base core 23 and cover core 24 in the transformer 21 as described above, the primary conductive member 33 and secondary conductive member 34 being disposed within the grooves 30, 30 and so forth. The core 22 for the inductive element is produced by integrating the base core 23 with the cover core 24.

The base core 23 may be adhered with the cover core 24 with an adhesive or the two may be pinched with a flat spring.

A gap may be provided between the top faces 28*a*, 28*b* and so forth and 28*a* of the projections 27*a*, 27*b* and so forth and 27*a* of the base core 23 and the bottom face 29 of the cover core 24 for the purpose of suppressing magnetic saturation or adjusting inductance level. This gap is formed by inserting an insulation material such as a resin plate. The favorable insulation materials to be used for this gap are resins with as small dielectric constant as possible, most suitable examples of them being films of polyimide, polyvinyl chloride, polystyrene, polyester, fluorinated resin and epoxy resin. These resins have sufficiently small dielectric constant in the range from 2 through 4 and a suitable resin is selected and used among them.

Figure 4A:
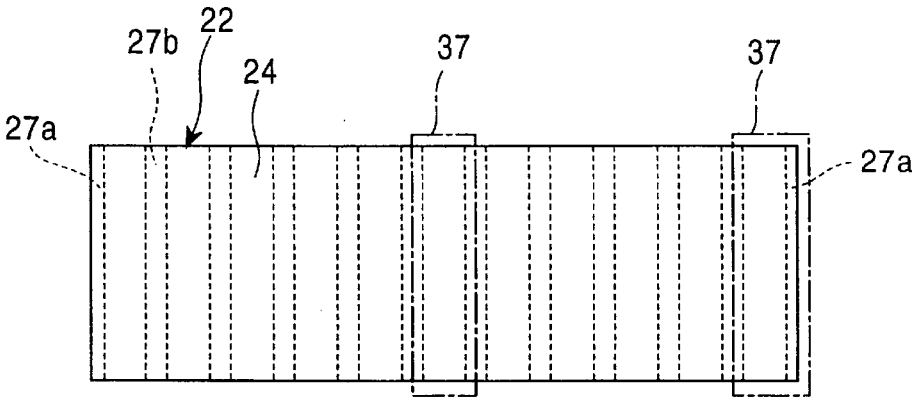
FIG. 4 is a drawing showing the core for the inductive element according to the embodiment of the present invention, wherein A is a plane view, B is a side view and C is a front view.
Figure 4B:
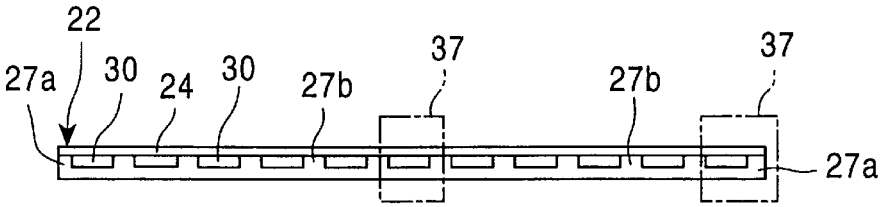
Figure 4C:
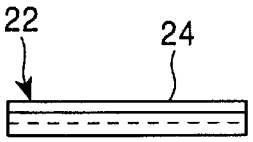
Figure 5A:
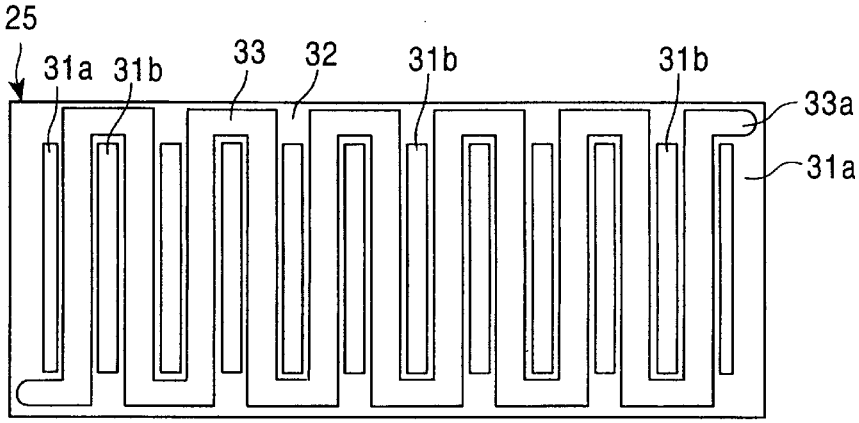
FIG. 5 is a drawing showing the conductive plate for the transformer provided with the core for the inductive element according to the embodiment of the present invention, wherein A is a plane view, B is a side view, C is a front view and D is a rear view.
Figure 5B:
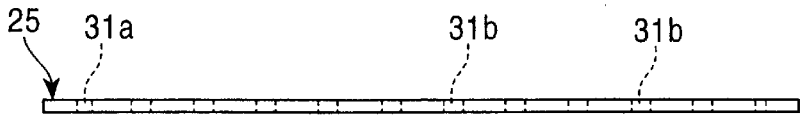
Figure 5C:
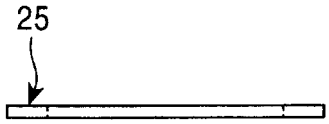
Figure 5D:
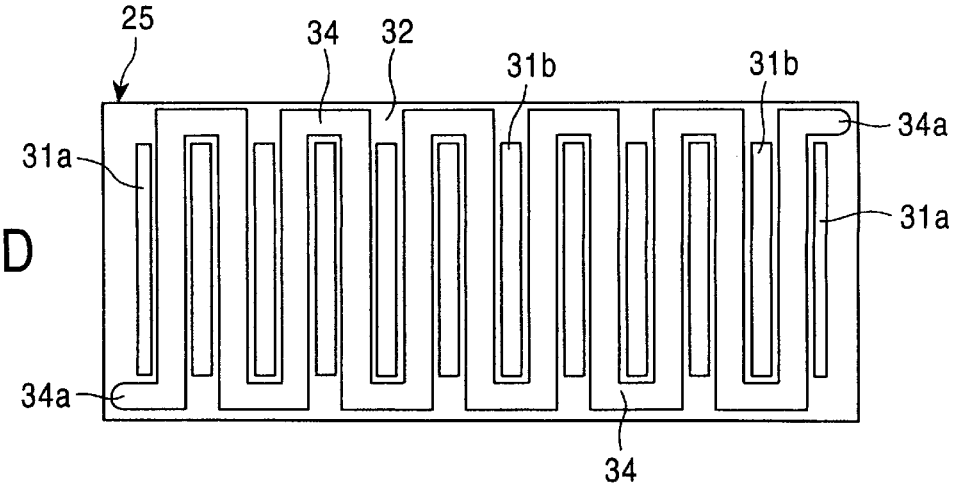

Mutually independent closed magnetic circuits for allowing magnetic flux created by the impressed voltage on the primary conductive member 33 to pass through are formed with the base part 26, the projections 27*a*, 27*b* and so forth and 27*a* and the cover core 24 in the core 22 for the inductive element as shown in FIG. 4A. These are termed as unit cores 37, 37 and so forth (within the frame surrounded by the dotted line). There are eleven unit cores 37 since eleven grooves 30 are provided.

Accordingly, one or more of the unit cores 37, 37 and so forth are disposed in the same plane in the core 22 for the inductive element.

The primary conductive member 33 and the secondary conductive member 34 serve as an inductive element for generating inductance that is determined by the cross sectional area of the magnetic circuit of the unit cores 37, 37 and so forth and magnetic permeability of the magnetic substance by being disposed in the unit cores 37, 37 and so forth.

The primary conductive member 33 and the secondary conductive member 34 are magnetically coupled with the unit cores 37, 37 and so forth, wherein the primary conductive member 33 and the secondary conductive member 34 serve as a primary coil and secondary coil of the transformer, respectively.

When the primary conductive member 33 and the secondary conductive member 34 are disposed in the unit cores 37, 37 and so forth, the inductance level obtained is proportionally increased.

Accordingly, the primary conductive member 33 and the secondary conductive member 34 may be disposed in a lot of unit cores 37, 37 and so forth when a large inductance level is required.

In the case of this transformer 21, the primary conductive member 33 and the secondary conductive member 34 are disposed in eleven unit cores 37, 37 and so forth.

Therefore, voltage increasing ratio of this transformer 21 is equal to the primary to secondary ratio (11:11=1:1).

When the secondary conductive member 34 is disposed in only five unit cores 37 in the transformer 21, for example, the primary to secondary ratio becomes 11:5, serving as a voltage decreasing type transformer. When the secondary conductive members 34 are stacked via insulation materials to dispose them in total 22 unit cores, the primary to secondary ratio becomes 11:22=1:2, serving as a voltage increasing type transformer.

As is apparent from the description above, since a transformer with an arbitrary voltage-increasing or voltage decreasing ratio can be constructed by appropriately changing the disposition of the primary conductive member 33 or secondary conductive member 34 in the unit core 37 in the transformer according to the present invention, a large degree of freedom in circuit design can be obtained.

The core 22 for the inductive element according to the present invention comprises a Mn—Zn ferrite with a mean particle size of 5 $\mu$m or less obtained by baking after molding a starting powder material of the Mn—Zn ferrite formed into grains at a temperature range where shrinkage ratio due to baking is stabilized.

The composition of the Mn—Zn ferrite is, in mol %, 52 to 55 of $Fe_2O_3$, 5 to 20 of ZnO and 25 to 40 of MnO.

Additives such as CaO, $Ta_2O_5$, $SiO_2$ and $TiO_2$ may be added.

The starting powder material of the Mn—Zn ferrite comprising $Fe_2O_3$, ZnO and MnO is preferably produced by a hydrothermal synthesis method. The hydrothermal synthesis method as used herein refers to a kind of solution method for synthesizing powders from a liquid sate, which is known as a method for producing a powder containing relatively small amount of coarse coagulated particles and which is a method for producing powder particles by an aqueous treatment of a suspended alkali solution under a high pressure and high temperature. The reaction proceeds by allowing two or more kinds of compounds such as oxides in the solution or solid to participate to synthesize a desired compound. Alkali metal ions that are present in the solution are frequently used as one of the compounds in the reaction as described above.

In producing the powder starting material of the Mn—Zn ferrite by the hydrothermal synthesis method, an aqueous solution of metallic compounds containing a prescribed amount of Mn, Zn and Fe is first prepared. While a variety of water soluble compounds may be used for the compounds containing these elements, chlorides or nitrides are preferably used. A suspended alkali solution is then prepared by allowing the aqueous solution of the metallic compounds to contact with or to be mixed with an aqueous solution of, for example, NaOH, KOH or ammonia.

This suspended alkali solution is placed into a pressurizing vessel such as an autoclave in the next step followed by forming a ferrite precipitate by a hydrothermal treatment at 120 to 250° C. The desired starting powder material is obtained by drying the ferrite precipitate obtained.

When the additives such as CaO, $Ta_2O_5$, $SiO_2$ and $TiO_2$ are added, these additives exhibit an effect for suppressing core loss by decreasing excessive current loss due to suppressed grain growth by these additives. A core loss decreasing effect may be also obtained due to decreased lattice defects in the ferrite by forming a solid solution of these additives into the solid phase of the principal ferrite component. The additives are added by mixing a proper volume of the prepared aqueous solution of the metallic compounds.

The preferable amount of CaO for adding into the powder starting material is from 0.02 through 0.25 mol % in the ferrite in order to decrease the core loss of the Mn—Zn ferrite. The more preferable range is from 0.02 through 0.2 mol % since magnetic characteristics such as initial magnetic permeability is deteriorated when the amount of added CaO is too large.

The amount of addition of $Ta_2O_5$ for adding into the starting powder material is preferably in the range from 0.02 through 0.35 mol % in the ferrite in order to decrease the core loss of the ferrite.

The amount of addition of $SiO_2$ in the starting powder material is preferably in the range from 0 through 0.3 mol % in the ferrite in order to decrease the core loss of the ferrite.

The amount of addition of $TiO_2$ in the starting powder material is preferably in the range from 0.1 through 1.5 mol % in the ferrite in order to decrease the core loss of the Mn—Zn ferrite. The more preferable range is from 0.1 through 1.3 mol % since magnetic characteristics such as initial magnetic permeability is deteriorated when the amount of added CaO is too large.

The starting powder material obtained may be calcinated in a reducing atmosphere for the purpose of accelerating a proper grain growth after allowing the additive elements to dissolve in the ferrite solid. The reducing atmosphere as used herein refers to an atmosphere to cause a reducing reaction in the ferrite such as a nitrogen, vacuum or argon atmosphere. The calcination temperature is preferably in the range from 700 through 930 ° C., the temperature range of from 850 through 930° C. being more preferable.

When the carcination temperature is less than 700° C., decrease in core loss can not be attained because the reducing reaction is not sufficiently proceeded to result in insufficient formation of solid solution of the additives. When the carcination temperature exceeds 930° C., the crystal grain growth is too accelerated causing deterioration of characteristics.

This starting powder material of the Mn—Zn ferrite is then formed into grains followed by molding the powder in a mold with a desired inner shape of the mold.

The powder was formed into grains by adding a small amount of organic binder followed by passing through a 100 mesh sieve to prepare a powder free from coagulations. Otherwise, a hollow granular powder may be produced by simultaneously subjecting to drying and grain formation using a spray dryer after forming the powder starting material into a slurry by adding water.

The desired Mn—Zn ferrite is obtained by baking the molded body obtained. It is preferable that the baking is carried out at a temperature range where shrinkage ratio is stabilized. The shrinkage ratio as used herein refers to a measured value of $\Delta L/L_0$ (%) provided that the length of the molded body before baking is $L_0$ and the length changed by baking is $\Delta L$.

While the shrinkage ratio is increased as the baking temperature becomes higher, a constant shrinkage ratio is obtained in the temperature range of from about 900 through 1130° C. This temperature range is referred to the temperature range where the shrinkage ratio is stabilized. The shrinkage ratio does not experience any change within this temperature range from about 900 through 1130° C.

When the baking temperature is increased above 1130° C., the shrinkage ratio is decreased.

The density of the baked body becomes insufficient at a temperature below 900° C., being not preferable since the core loss is increased.

A baking temperature of more than 1130° C. is not preferable since it causes a core loss ascribed to a rapid grain growth.

It is possible to adjust the crystal grain size to 5 $\mu$m or less at the temperature range of from 900 to 1130° C. where the shrinkage ratio becomes constant, enabling to largely decrease the core loss since the relative density of the baked body can be made to be 95% or more.

It is more preferable that baking is carried out at a temperature where the mean grain size of the Mn—Zn ferrite becomes 1.3 to 3.0 $\mu$m.

The core loss at a high frequency band can be largely decreased when the mean grain size of the Mn—Zn ferrite is 5 $\mu$m or less, more preferably in the range of 1.3 to 3.0 $\mu$m.

The base core 23 shown in FIG. 2A to FIG. 2C is obtained by forming the projections 27*a*, 27*b* and so forth and 27*a* after cutting the grooves 30, 30 and so forth on a block of the Mn—Zn ferrite after molding and baking, or by molding, followed by baking, the starting powder material of the Mn—Zn ferrite with a mold having an inner mold with the shape of the base core 23.

When the core 22 for the inductive element produced by using such Mn—Zn ferrite is used for the transformer 21, a transformer 21 with a core loss of 200 to 500 kW/m$^2$ and a performance coefficient of 50 to 300 at 1 MHz can be obtained, wherein the frequency range where a maximum performance coefficient is obtained is in the range from 0.2 to 2 MHz.

The starting powder material may be prepared by a co-precipitation method other than the hydrothermal synthesis method provided that the mean grain size of the starting powder material of the Mn—Zn ferrite is possibly suppressed small.

A dry method by which fine powders of $Fe_2O_3$, ZnO and MnO is mixed, molded and baked may be applied for obtaining the core 22 for the inductive element.

Since the core 22 for the inductive element as hitherto described comprises a Mn—Zn ferrite with a mean grain size of 5 $\mu$m or less obtained by baking after molding the starting powder material of the Mn—Zn ferrite formed into grains that has been obtained by the hydrothermal synthesis method, thereby core loss at a high frequency band can be reduced.

The core 22 for the inductive element comprised a base part 26, a base core 23 or 51 composed of two or more of projections 27*a*, 27*b* and so forth and 27*a* or a group of projections 54*a*, 54*b* and so forth and 54*a* comprising a plurality of projections 53*a*, 53*b* and so forth and 53*a* projected out of one face of the base 26 along one direction of the base 26 and a cover core 24 having an approximately rectangular shape in the plane view with a given thickness. Since a lot of unit cores 37 are formed when the base core 23 or 51 are integrated with the cover core 24, the inductive element capable of making the size thin can be produced.

A plurality of projections 27*a*, 27*b* and so forth and 27*a* or a group of projections 54*a*, 54*b* and so forth and 54*a* are aligned along the longitudinal direction of the base part 26 in the base core 23 or the base core 51. Different from the conventional base core 6 in which a lot of cubic projections 5, 5 and so forth are projected out of the base 4 forming a plurality of arrays along the transverse and vertical directions, the configuration of the base core according to the present invention is so simplified that the base core 23 or the base core 51 can be readily produced.

The effective cross sectional area of the magnetic flux at the unit cores 37, 37 and so forth can be made larger in the core 22 for the inductive element as described above than in the core 2 for the conventional inductive element, thereby making it possible to generate larger inductance.

Since the ratio between the surface area S1 of the base 26 and the total area S2 of the top faces 28*a*, 28*b* and so forth and 28*a* of the projections 27*a*, 27*b* and so forth and 27*a* satisfies the relation of $1.1 \leqq S1/S2 \leqq 5.5$, the cross sectional area of the closed magnetic circuit of the unit cores 37, 37 and so forth can be appropriately adjusted.

The leakage flux density can be also made small because the projections 27*a* and 27*a* or a group of projections 54*a* and 54*a* are provided at both ends of the base core 23 and the base core 51 of the core 22 for the inductive element.

The core 22 for the inductive element as described above has a composition of, in mol %, 52 to 55 of $Fe_2O_3$, 5 to 20 of ZnO and 25 to 40 of MnO besides having a relative density of 97% or more and a mean grain size of 1.3 to 3.0 Am. Moreover, the core loss is 200 to 500 $kW/m^3$ under the condition of 1 MHz and 50 mT and the performance coefficient is 50 to 300 at 1 MHz in the Mn—Zn ferrite along with exhibiting a maximum performance coefficient at a frequency range from 0.2 through 2 MHz. Therefore, an inductive element with a small core loss at a high frequency band can be produces.

The transformer 21 is provided with a core 22 for the inductive element and a conductive plate 25 for the transformer provided with the primary conductive member 33 and secondary conductive member 34 formed on one face or both faces of the insulation plate 32. Since this conductive plate 25 for the transformer is readily produced by etching the printed board, the production cost of the transformer 21 can be largely reduced.

Further, since the transformer 21 can be readily produced by merely inserting the conductive plate 25 for the transformer between the base core 23 or the base core 51 and cover core 24, the production cost can be also reduced through a simplified production process.

Moreover, since the transformer 21 described above is provided with the core 22 for the inductive element according to the present invention, core loss at a high frequency band is small thus preventing the power transmission efficiency from being decreased.

FIG. 7A to FIG. 7D show the conductive plate 49 for the inductor provided with an insulation plate 47, through which slender holes 46*a*, 46*b* and so forth and 46*a* for allowing the projections 27*a*, 27*b* and so forth and 27*a* on the base core 23 to penetrate are drilled, and a conductive member 48 disposed forming a zigzag route along the peripheries of the slender holes 46*a*, 46*b* and so forth and 46*a* on one face of the insulation plate 47.

The inductor (not shown in the drawing) is assembled by disposing this conductive plate 49 for the inductor so as to be sandwiched between the base core 23, or the core 22 for the inductive element, and the cover core 24.

In other words, the conductive plate 49 for the inductor is at first mounted on the base core 23 by allowing the projections 27*a*, 27*b* and so forth and 27*a* to penetrate through the slender holes 46*a*, 46*b* and so forth and 46*a*.

Then, the cover core 24 is mounted on the conductive plate 49 for the inductor by adhering the bottom face 29 with the top faces 28*a*, 28*b* and so forth and 28*a* of the projections 27*a*, 27*b* and so forth and 27*a*.

The conductive plate 49 for the inductor is disposed in the inductor (not shown in the drawing) so as to be sandwiched between the base core 23 and cove core 24 along with disposing the conductive member 48 in the grooves 30, 30 and so forth. The core 22 for the inductive element is assembled by integrating the base core 23 with cover core 24.

The conductive member 48 serves as an inductive element for generating inductance determined by the cross sectional area of the unit core 37 and magnetic permeability of the magnetic substance by being disposed in the unit cores 37, 37 and so forth.

When the conductive member 48 is disposed in the unit cores 37, 37 and so forth, the inductance obtained is proportionally increased.

Accordingly, a lot of unit cores 37, 37 and so forth may be disposed when a large inductance is required.

Since the inductor (not shown in the drawing) is provided with the core 22 for the inductive element made of the Mn—Zn ferrite described previously, its core loss at a high frequency band can be made small along with making its dimension thin.

Since the inductor (not shown in the drawing) is produced by disposing the conductive member 49 for the inductor so as to be sandwiched between the base core 23 and cover core 24, the inductor can be easily produced to reduce the production cost.

The second embodiment according to the present invention will be described hereinafter referring to the drawings.

As shown in FIG. 8A to FIG. 8D, the transformer 61 is composed of a base core 63 comprising the Mn—Zn ferrite as a core 62 for the inductive element and a cover core 64 comprising the Mn—Zn ferrite, and a conductive plate 65 for the transformer.

Figure 9A:
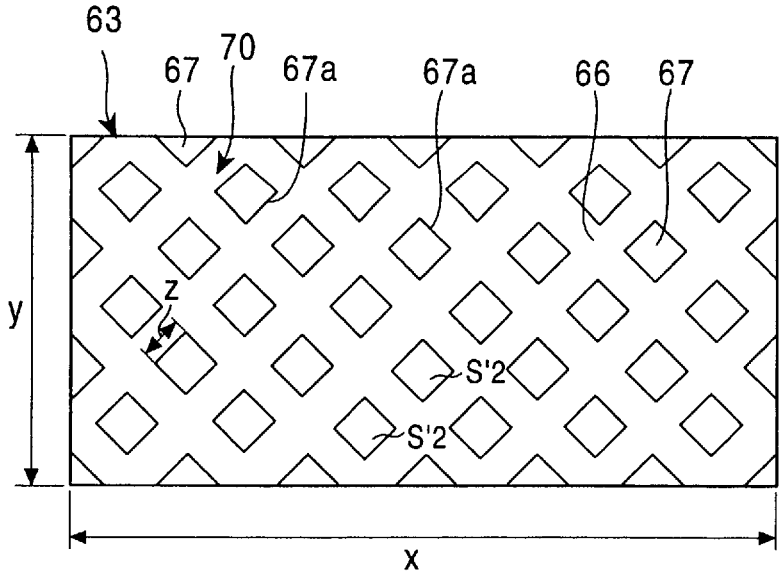
FIG. 9 is a drawing showing the base core of the core for the inductive element according to the embodiment of the present invention, wherein A is a plane view, B is a side view and C is a front view.
Figure 9B:
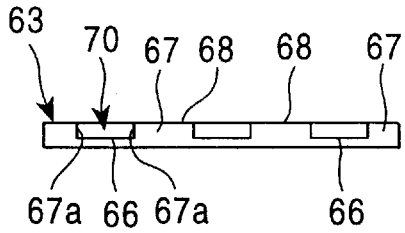
Figure 9C:
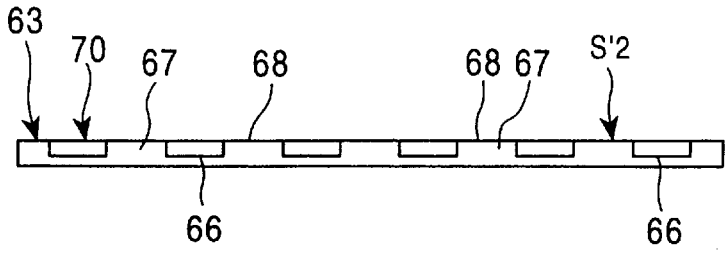

The base core 63 is composed of a plate of the base part 66 and a lot of pillar-shaped projections 67, 67 and so forth projected out of one face of the base plate 66 aligned with a given space apart as shown in FIG. 9A to FIG. 9C. While the pillar-shaped projection 67, 67 and so forth with approximately square and triangle shapes are distributed together in FIG. 9A, the shapes are not limited thereto but a variety of cross sections such as triangles, rectangles, polygons or ellipses are acceptable.

The pillar-shaped projections 67, 67 and so forth are formed to have the same height with each other. It is not preferable that the height is not the same with each other since all the pillar-shaped projections 67, 67 and so forth can not be adhered with the bottom face 69 of the cover core 64 as will be described hereinafter.

Concave portions 70 divided by side faces 67*a* and 67*a* of the two adjoining and confronting pillar shaped projections 67 and 67 and the base plate 66 are provided on the base core 63. Since 46 pillar shaped projections 67, 67 and so forth are provided in this drawing, there are 72 concave portion 70, 70 and so forth among the two adjoining pillar-shaped projections.

Provided that the length of edge of the base core 63 along the longitudinal direction be x and the length of the remaining edges be y as shown in FIG. 9A, then the area S'1 of the base plate 66 satisfies the relation of S'1=xy.

Provided that the length of one edge of the top face 68 of the pillar shaped projection 67 be z, then the total area S'2 of the top faces 68, 68 and so forth of the pillar-shaped projections 67, 67 and so forth is represented by $S'2=28Z^2+14/2Z^2+4/4Z^2=36Z^2$, since there are 28 square pillar shaped projections, 14 triangular pillar shaped projections at each edge having an area of one-half of the area of the square, and four triangular pillar-shaped projections at four corners having an area of one-fourth of the area of the square.

It is preferable that the ratio between S'1 and S'2 satisfies the relation of $2 \leqq S'1/S'2 \leqq 16$.

It is not preferable that the ratio S'1/S'2 is less than 2 since the cross sectional area of the closed magnetic circuit of the base plate 66 becomes extremely small. The ratio S'1/S'2 of more than 16 is also not preferable since the cross sectional area of the closed magnetic circuit of the pillar-shaped projections 67, 67 and so forth becomes extremely small.

Figure 10A:
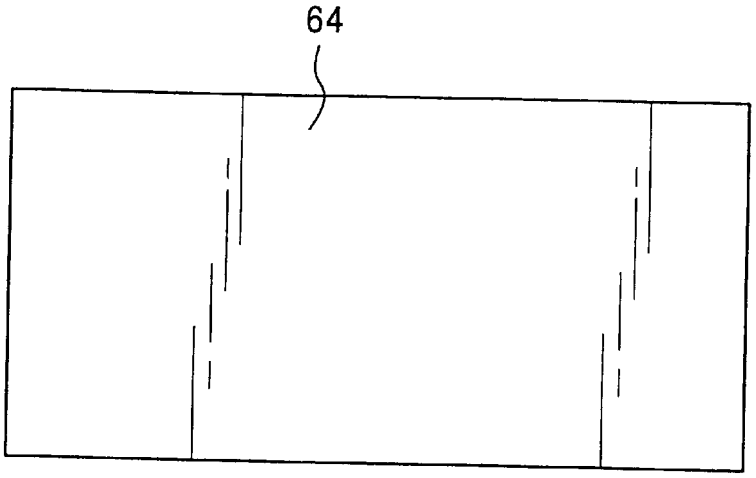
FIG. 10 is a drawing showing the cover core of the core for the inductive element according to the embodiment of the present invention, wherein A is a plane view, B is a side view and C is a front view.
Figure 10B:
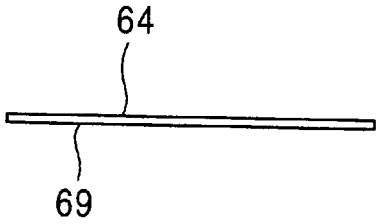
Figure 10C:
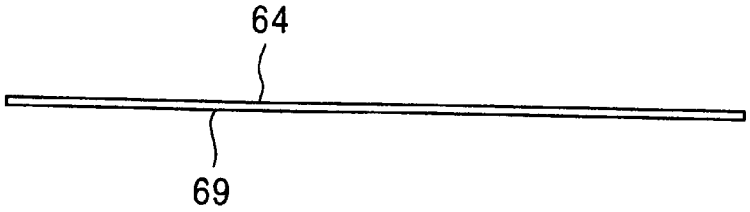

The cover core 64 of the core 2 of the inductive element assumes a plate shape as shown in FIG. 10A to FIG. 10c.

As shown in FIG. 12A to FIG. 12D, the conductive plate 65 for the transformer are provided with an insulation plate 72, through which holes 71, 71 and so forth for allowing the projections 67, 67 and so forth on the base core 63 to penetrate are drilled, a primary conductive member 73 formed on one face of the insulation plate 72 and secondary conductive members 74, 75 and 76 formed on the other face of the insulation plate 72.

The primary conductive member 73 and the secondary conductive members 74, 75 and 76 are disposed forming a zigzag route along the peripheries of the holes 71, 71 and so forth, being disposed so that the current flow direction of the secondary conductive members 74, 75 and 76 crosses with the current flow direction of the primary conductive member 73 at a right angle.

An insulation layer (not shown in the drawing) is formed on the primary conductive member 73 and secondary conductive members 74, 75 and 76 in order to insulate against the core 62 for the inductive element.

The primary conductive member 73 is connected to external lead wires (not shown in the drawing) via a primary terminal 73*a*.

The secondary conductive members 74, 75 and 76 are connected with a lead wire 74*b* in parallel with each other via secondary terminals 74*a*, 74*a* and 74*a*, which are connected to external lead wires (not shown in the drawing).

The insulation plate 72 is made of highly insulating materials such as a glass-epoxy material, a paper-epoxy material or a phenol resin.

While the primary conductive member 73 and the secondary conductive members 74, 75 and 76 are formed of a copper foil on the insulation plate 32, the material is not limited thereto but materials such as a copper plate or a copper wire may be preferably selected and used depending on the power to be impressed on the transformer.

Materials such as a glass-epoxy material, paper-epoxy material and phenol resin are used for the insulation layer formed on the primary conductive member 73 and the secondary conductive members 74, 75 and 76.

The conductive plate for the transformer having such construction can be readily produced by, for example, subjecting the multi-layer printed board to an etching treatment of the patterns for the primary conductive member 73 and the secondary conductive members 74, 75 and 76 followed by drilling holes 71, 71 and so forth.

Figure 8A:
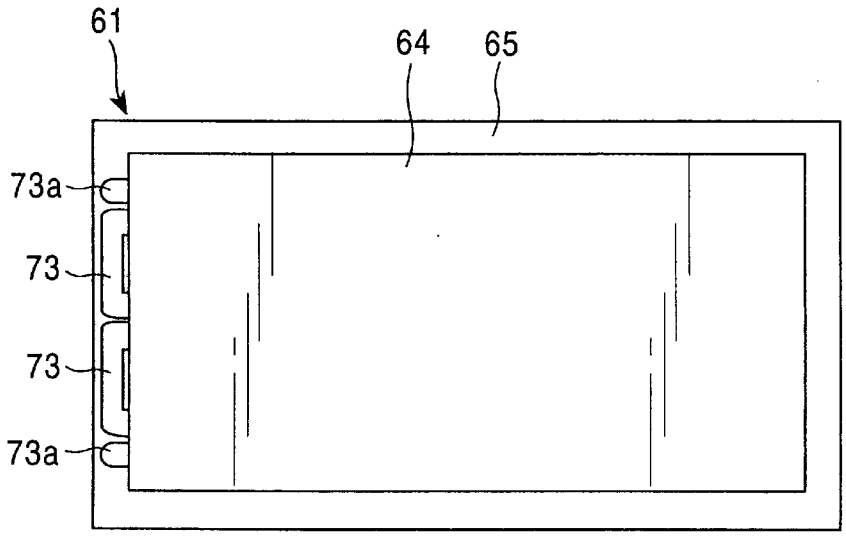
FIG. 8 is a drawing showing the transformer provided with the core for the inductive element according to the embodiment of the present invention, wherein A is a plane view, B is a side view, C is a front view and D is a rear view.
Figure 8B:
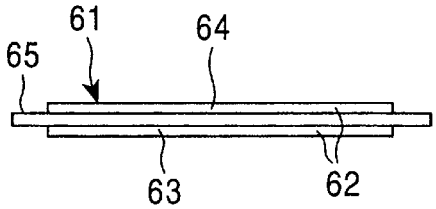
Figure 8C:
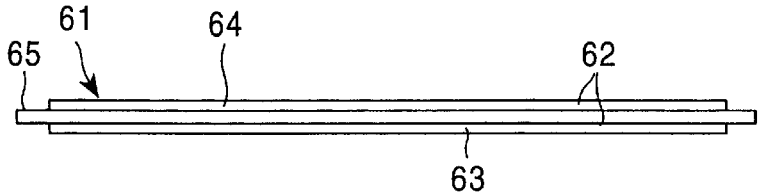
Figure 8D:
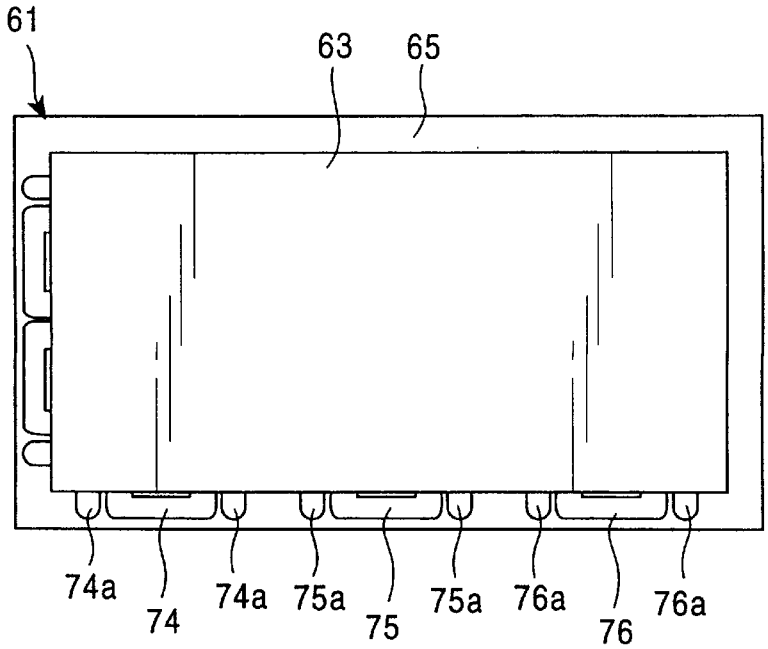

The conductive plate 65 for the transformer is disposed so as to be sandwiched between the base core 63 and the cover core 64 as shown in FIG. 8A to FIG. 8C.

In other words, the conductive plate 65 for the transformer is at first mounted on the base core 63 by allowing the pillar-shaped projections 67, 67 and so forth to penetrate through the holes 71, 71 and so forth.

Then, the cover core 64 is mounted on the conductive plate 65 for the transformer by adhering its bottom face 69 with the top faces 68, 68 and so forth of the pillar-shaped projections 67, 67 and so forth.

The conductive plate 65 for the transformer is disposed so as to be sandwiched between the base core 63 and the cover core 64 along with disposing the primary concuctive member 73 and the secondary conductive members 74, 75 and 76 in the concave portions 70, 70 and so forth. The core 62 for the inductive element is assembled by integrating the base core 63 with the cover core 64.

The base core 63 may be adhered with the cover core 64 or the two may be pinched with a metallic flat spring.

A gap may be provided between the top faces 68*a*, 68*b* and so forth and 68*a* of the projections 68, 68 and bottom face 69 of the cover core 64 for the purpose of suppressing magnetic saturation or adjusting inductance level. This gap is formed by inserting an insulation material such as a resin plate. The favorable insulation materials to be used for this gap are resins with as small dielectric constant as possible, most suitable examples of them being films of polyimide, polyvinyl chloride, polystyrene, polyester, fluorinated resin and epoxy resin. These resins have sufficiently small dielectric constant in the range from 2 through 4 and a suitable resin is selected and used among them.

Figure 11A:
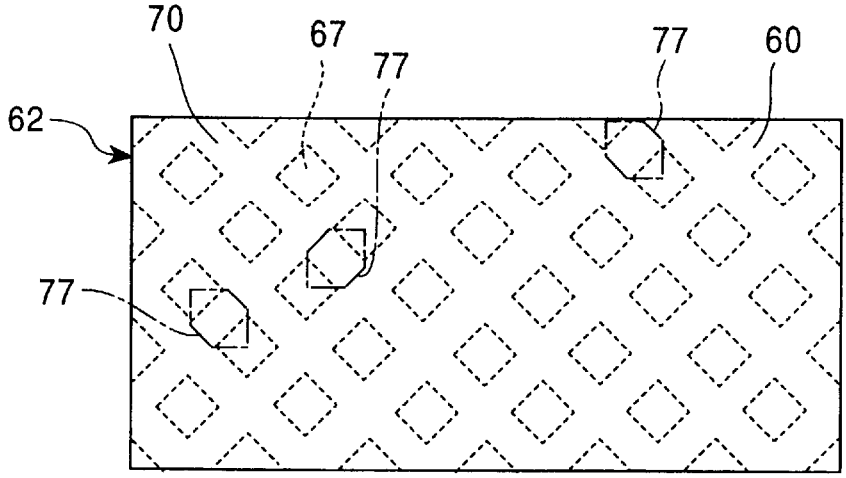
FIG. 11 is a drawing showing the core for the inductive element according to the embodiment of the present invention, wherein A is a plane view, B is a side view and C is a front view.
Figure 11B:
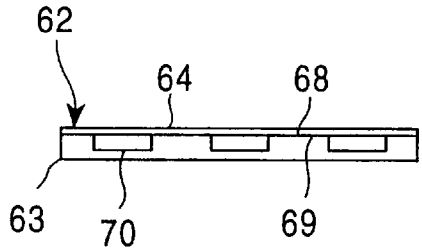
Figure 11C:
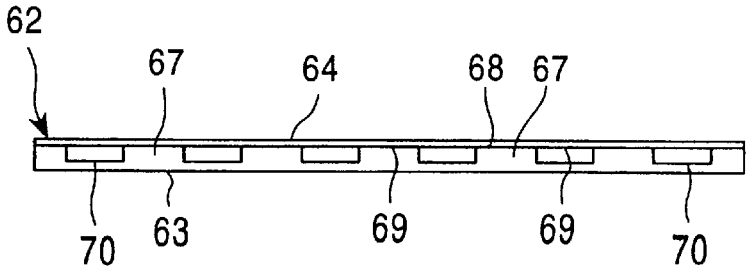
Figure 12A:
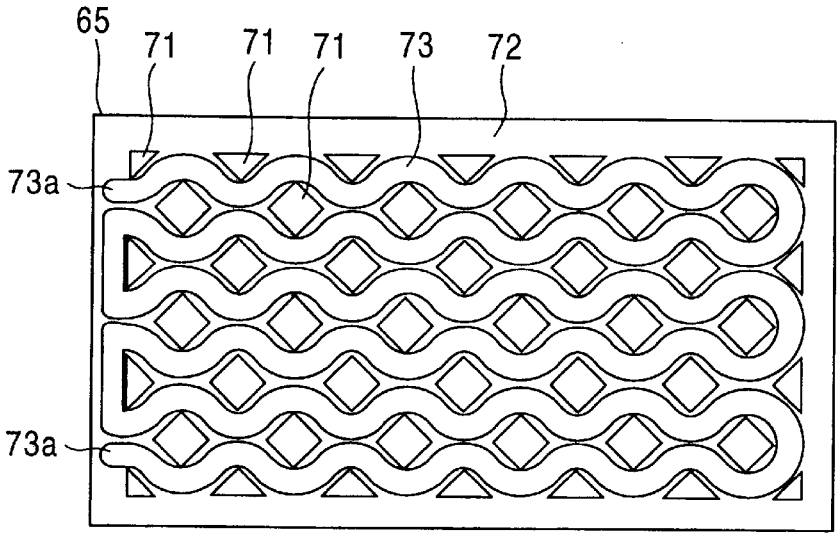
FIG. 12 is a drawing showing the conductive plate for the transformer of the transformer provided with the core for the inductive element according to the embodiment of the present invention, wherein A is a plane view, B is a side view, C is a front view and D is a rear view.
Figure 12B:
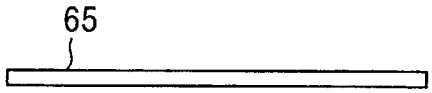
Figure 12C:
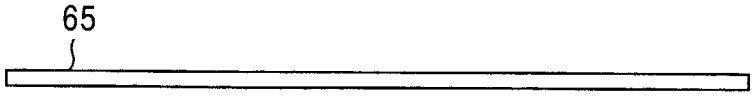
Figure 12D:
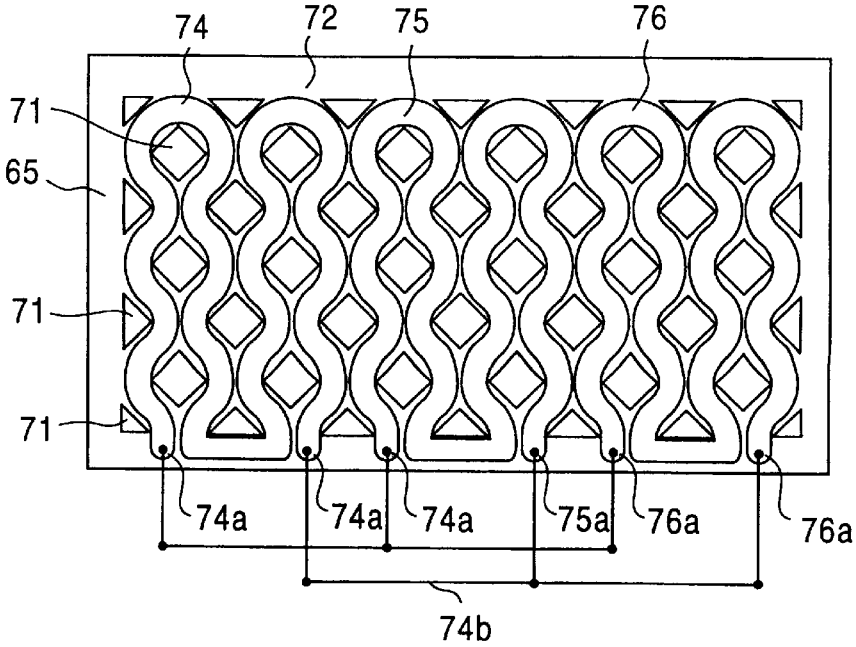

Mutually independent closed magnetic circuits for allowing magnetic flux created by the impressed voltage on the primary conductive member 73 to pass through are formed with the base plate 66, projections 67*a*, 67*b* and the cover core 64 in the core 62 for the inductive element as shown in FIG. 11A. These are termed as unit cores 67, 67 and so forth (within the frame surrounded by the dotted line). There are 72 unit cores 77 since 72 grooves 70, 70 and so forth are provided.

Accordingly, one or more of the unit cores 77, 77 and so forth are disposed in the same plane in the core 62 for the inductive element.

The primary conductive member 73 and the secondary conductive members 74, 75 and 76 serve as inductive elements for generating inductance that is determined by the cross sectional area of the magnetic circuit of the unit cores 77 and magnetic permeability of the magnetic substance by being disposed in the unit cores 77, 77 and so forth.

The primary conductive member 73 and the secondary conductive member 74, 75, 76 are magnetically coupled with the unit cores 77, 77 and so forth, the primary conductive member 73 and the secondary conductive members 74, 75 and 76 serving as a primary coil and secondary coils of the transformer, respectively.

When the primary conductive member 73 and secondary conductive members 74, 75 and 76 are disposed in the unit cores 77, 77 and so forth, the inductance obtained is proportionally increased.

Accordingly, the primary conductive member 73 and secondary conductive members 74, 75 and 76 may be disposed in a lot of unit cores 77, 77 and so forth when a large inductance is required.

The primary conductive member 73 is disposed in series in the 72 unit cores 77 in the cease of this transformer 61. Each of the secondary conductive members 74, 75 and 76 is disposed in series in the 24 unit cores 77, the secondary conductive members 74, 75 and 76 being also connected in parallel with each other.

Accordingly, the voltage increasing ratio of this transformer 61 is equal to the primary to secondary ratio (72:24=3:1).

The core 62 for the inductive element according to the present invention comprises a Mn—Zn ferrite with a mean grain size of 5 $\mu$m or less obtained by baking after molding the starting powder material of the Mn—Zn ferrite formed into grains at a temperature range where the shrinkage ratio due to baking is stabilized.

The composition of this Mn—Zn ferrite comprises, in mol %, 52 to 55 of $Fe_2O_3$, 5 to 20 of ZnO and 25 to 40 of MnO.

Additives such as CaO, $Ta_2O_3$, $SiO_2$ and $TiO_2$ may be added, giving a preferable effect by adding the same quantity of additives as described in the foregoing first embodiment. The Mn—Zn ferrite as hitherto described can be obtained by the same production method as described in the foregoing first embodiment.

The base core 63 shown in FIG. 9A to FIG. 9C is produced by cutting a latticework of grooves to form convex portions 70, 70 and so forth and pillar shaped projections 67, 67 and so forth with a grindstone on the Mn—Zn ferrite obtained by baking after molding, or by baking after filling the starting powder material of the Mn—Zn ferrite into a mold having an inner mold of the shape of the base core 23.

When the core 62 for the inductive element from such Mn—Zn ferrite is used for the transformer, a transformer with a core loss of 200 to 500 kW/$m^3$ at 1 MHz and 50 mT and a performance coefficient of 50 to 300 at 1 MHz, besides having a frequency range of 0.2 to 2 MHz where the performance coefficient shows a maximum value, can be obtained.

The starting material may be produced by a co-precipitation method for forming hydroxides other than by the hydrothermal synthesis method, provided that the method is able to control the mean grain size of the starting powder material of the Mn—Zn ferrite small.

A dry method by which fine powders of $Fe_2O_3$, ZnO and MnO are mixed, molded and baked is also available for obtaining the core 62 for the inductive element.

The core 62 for the inductive element as hitherto described can reduce core loss at a high frequency band since it comprises a Mn—Zn ferrite with a mean grain size of 5 $\mu$m or less produced by baking after molding the starting powder material of the Mn—Zn ferrite, obtained by the hydrothermal synthesis method, formed into grains.

Furthermore, it is possible to produce a base core 63 having a complex shape.

The core 62 for the inductive element comprises the base core 63, provided with the base part 66 and the pillar-shaped projections 67, 67 and so forth projected out of one face of the base part 66, and the cover core plate 64. Since a lot of unit cores are formed when the base core is integrated with the cover core, it is possible to produce the core for the inductive element being possible to thin its size.

The ratio between the area S'1 of one face of the base part 66 and the total area S'2 of the top faces of the pillar-shaped projections 67, 67 and so forth satisfies the relation of $2 \leqq S'1/S'2 \leqq 16$, thereby making it possible to properly adjust the cross sectional area of the closed magnetic circuit of the unit core.

The core 62 for the inductive element described above has a composition, in mol %, with 52 to 55 of $Fe_2O_3$, 5 to 20 of ZnO and 25 to 40 of MnO, along with having a relative density of 97% or more, a mean grain size of 1.3 to 3.0 $\mu$m and the core loss of the Mn—Zn ferrite of 200 to 500 kW/m3 at 1 MHz and 50 mT besides the frequency where the performance coefficient exhibit a maximum value being in the range from 0.2 through 2 MHz. Therefore, the inductive element with small core loss at a high frequency band can be produced.

The transformer 61 is provided with the core 62 for the inductive element and the conductive plate 65 for the transformer provide with and the primary conductive member 73 and secondary conductive members 74, 75 and 76 formed on one face or on both faces of the insulation plate 72. The production cost of the transformer can be largely reduced since the conductive plate 65 for this transformer is easily produced by etching the printed board.

Moreover, the transformer is produced merely by inserting the conductive plate 65 between the base core 62 and cover core 63, so that the production process is simplified to reduce the production cost.

The voltage increasing ratio of the transformer 61 can be easily changed because at least two or more of the secondary conductive members 74, 75 and 76 are formed on the conductive plate 65 of the transformer 61.

Since the transformer 61 described above is also provided with the core for the inductive element according to the present invention, core loss at a high frequency band becomes small besides preventing the power transmittance efficiency from being decreased.

Figure 13A:
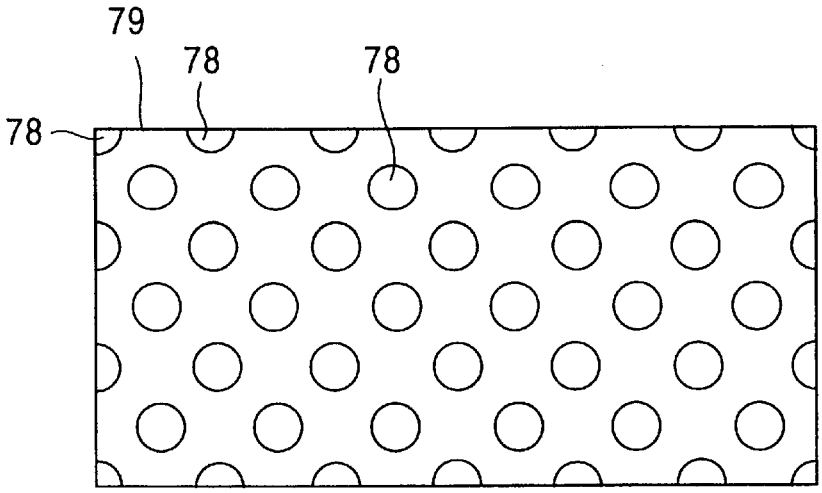
FIG. 13 is a drawing showing the base core of the inductive element according to the embodiment of the present invention, wherein A is a plane view, B is a side view and C is a front view.
Figure 13B:
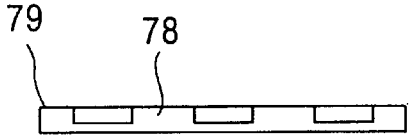
Figure 13C:
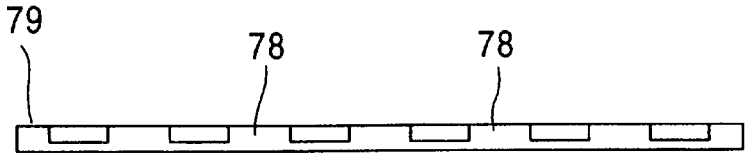
Figure 14A:
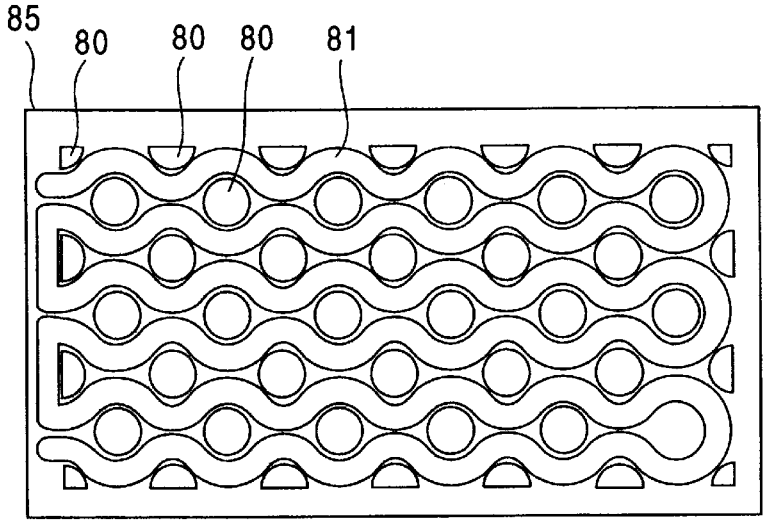
FIG. 14 is a drawing showing the conductive plate for the transformer of the transformer provided with the inductive element according to the embodiment of the present invention, wherein A is a plane view, B is a side view, C is a front view and D is a rear view.
Figure 14B:
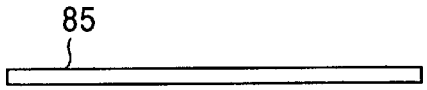
Figure 14C:
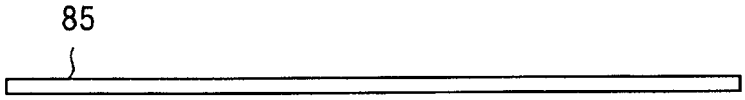
Figure 14D:
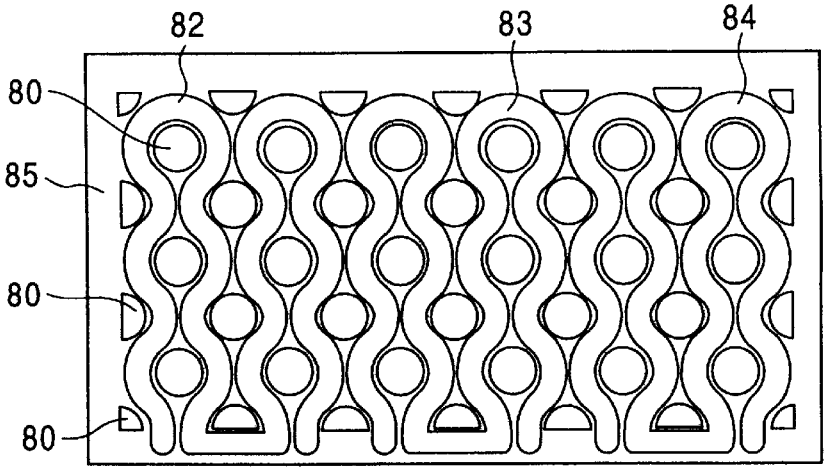
Figure 15A:
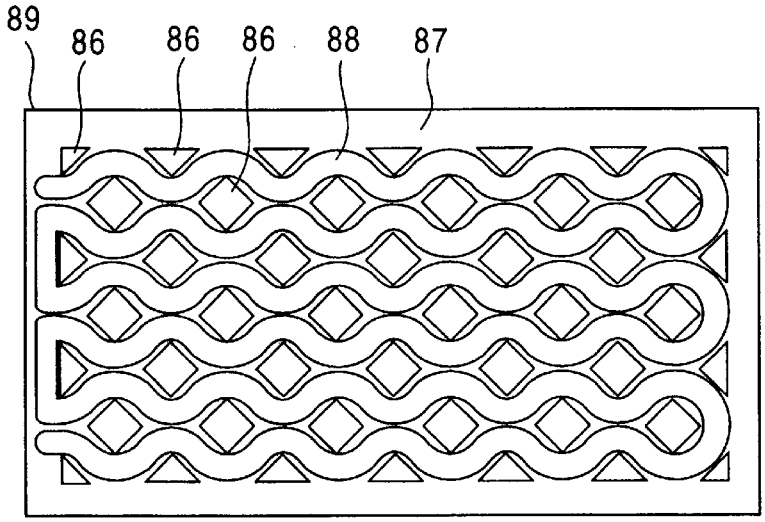
FIG. 15 is a drawing showing the conductive plate for the conductor of the conductor provided with the core for the inductive element according to the embodiment of the present invention, wherein A is a plane view, B is a side view, C is a front view and D is a rear view.
Figure 15B:
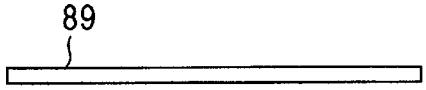
Figure 15C:
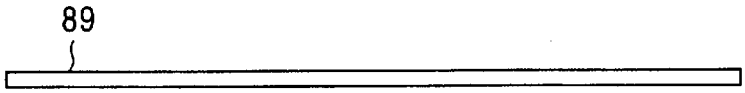
Figure 15D:
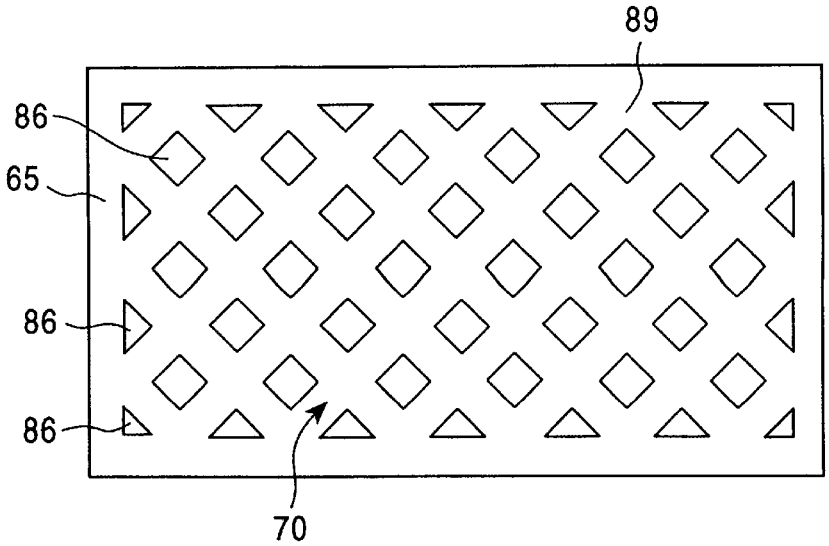
Figure 16:
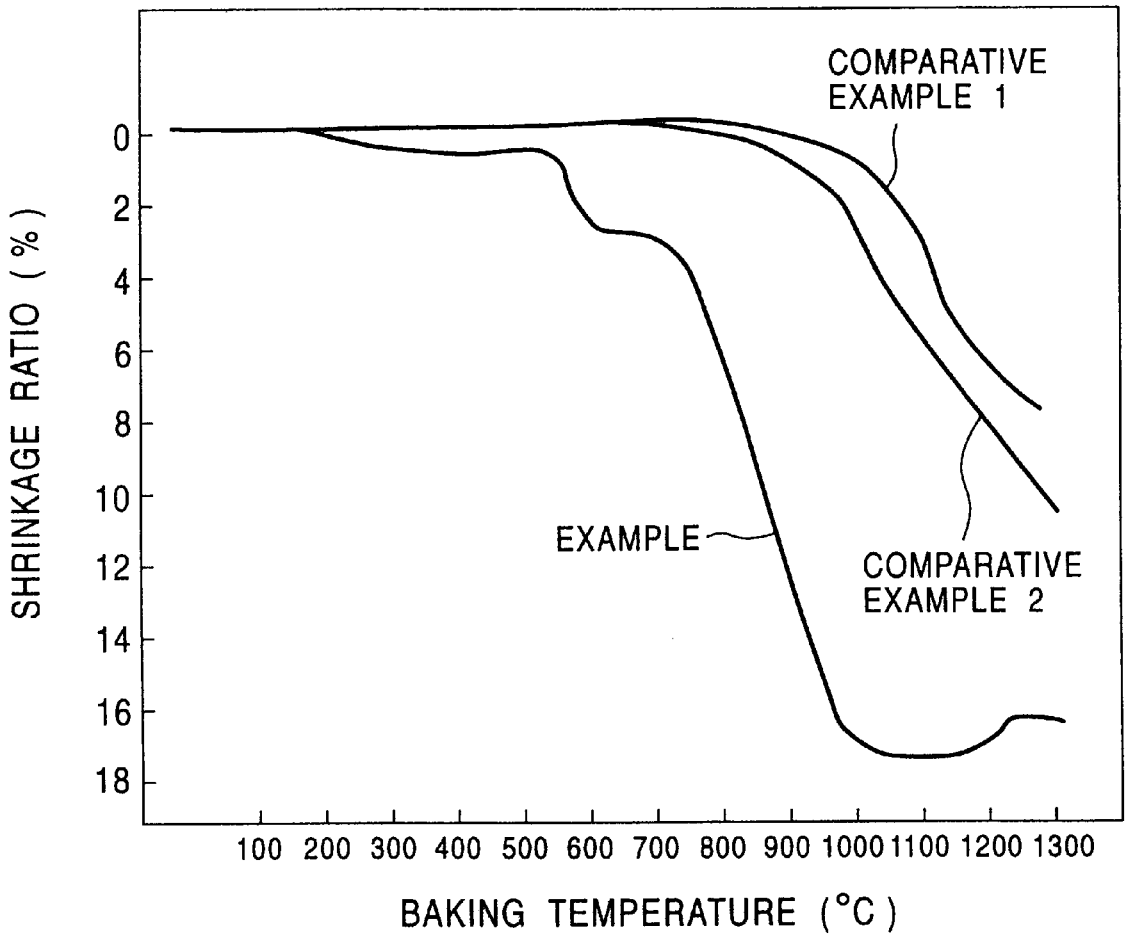
FIG. 16 is a graph showing the relation between the baking temperature and the shrinkage coefficient of the Mn—Zn ferrite according to the embodiment of the present invention.

A base core 79 having a circular cross section of the pillar-shaped projections 78, 78 and so forth as a different example of the base core is shown in FIG. 13A to FIG. 13C.

FIG. 14A to FIG. 14D show an inductive plate 85 for the transformer provided with circular holes 80, 80 and so forth and a primary conductive member 81 and secondary conductive members 82, 83 and 84 that form a zigzag route along the peripheries of these holes 80, 80 and so forth.

A transformer (not shown in the drawing) is produced by disposing this inductive plate 85 for the transformer so as to be sandwiched between the base core 79 and cover core 64.

Such transformer (not shown in the drawing) causes a good magnetic flux flow among the base core 79, primary conductive member 73 and secondary conductive members 74, 75 and 76 with small leakage magnetic flux besides preventing. the power transmission efficiency from being decreased. Such base core 79 can be obtained by filling the starting powder material of the Mn—Zn ferrite into a mold with a given shape followed by baking.

FIG. 15A to FIG. 15D show a conductive plate 89 for the inductor provided with an insulation plate 87, through which holes 86, 86 and so forth for allowing the pillar-shaped projections 67, 67 and so forth of the base core 63 are drilled, and a conductive member disposed forming a zigzag route on one face of the insulation plate 87.

An inductor (not shown in the drawing) is produced by disposing this conductive plate 89 so as to be sandwiched between the base core 63 as a core 62 for the inductive element and the cover core 64.

In other words, the conductive plate 89 for the inductor is at first mounted on the base core 63 by allowing the pillar-shaped projections 67, 67 and so forth to penetrate through the holes 86, 86 and so forth.

Then, the cover core 64 is mounted on the conductive plate 89 for the inductor by adhering its bottom face with the top faces 68, 68 and so forth of the pillar-shaped projections 67, 67.

The conductive plate 89 for the inductor is thus disposed so as to be sandwiched between the base core 63 and cover core 64 in the inductor (not shown in the drawing), besides the conductive member 88 being disposed in the concave portions 70, 70 and so forth. The core 62 for the inductive element is assembled by integrating the base core 63 with the cover core.

The conductive member 88 serves as an inductive element for generating inductance, determined by the cross sectional area of the magnetic circuit of the unit core 77 and magnetic permeability of the magnetic substance, by being disposed in the unit cores 77, 77 and so forth.

The inductance obtained is proportionally increased when the conductive member 88 is disposed in a plurality of unit cores 77, 77 and so forth.

Accordingly, a lot of unit cores 77, 77 and so forth may be disposed when a large inductance value is required.

Since the inductor described above (not shown in the drawing) is provided with the core 62 for the inductive element comprising the Mn—Zn ferrite, core loss at a high frequency band can be reduced along with making its shape thin.

Since the inductor (not shown in the drawing) is produced by disposing the conductive plate 89 for the inductor so as to be sandwiched between the base core 63 and cover core 64, the inductor can be easily produced besides lowering the production cost.

EXAMPLE

After adding an appropriate amount of an acrylic polymer as an organic binder into a starting powder material of Mn—Zn ferrite obtained by a hydrothermal synthesis method and having a composition of 53.6 mol % of $Fe_2O_3$, 7.1 mol % of ZnO and 39.3 mol % of MnO, the mixture was subjected to CIP molding at 196 MPa for 180 seconds followed by baking at 1050° C. for 4 hours in vacuum, thereby obtaining a baked body of the Mn—Zn ferrite with a mean grain size of 2.2 $\mu$m. A ring (outer diameter; 10 mm, inner diameter; 6 mm, thickness; 1.5 mm) for measuring core loss was sliced off from this baked body.

After cutting a block of the Mn—Zn ferrite with dimensions of 34 mm in width, 68 mm in length and 2.1 mm in height out of the baked body obtained, a lattice of grooves with a width of 4 mm and a depth of 1.3 mm, each groove being spaced 4 mm apart from the adjoining ones, was provided on the surface of the block with a grindstone, producing a base core as shown in FIG. 9 by forming pillar-shaped cubic projections with 4 mm in length of edges and 1.3 mm in height.

Meanwhile, a block of the Mn—Zn ferrite with a width of 34 mm, a length of 68 mm and a height of 0.9 mm was cut out of the baked body obtained to produce a cover core.

A conductive plate for the transformer was produced by forming a primary conductive member and a secondary conductive member with a width of 2 mm on both faces of a multi-layer printed board with a width of 40 mm, a length of 74 mm and a thickness of 1.2 mm, besides opening holes at the sites corresponding to the pillar-shaped projections on the base core.

Additionally, a transformer with an overall dimension of 40 mm in width, 74 mm in length and 3.0 mm in thickness was assembled by adhering the base core with the cover core while inserting the conductive plate for the transformer between them.

Comparative Example 1

After adding an appropriate amount of an acrylic polymer as an organic binder into a starting powder material of Mn—Zn ferrite obtained by a dry method and having a composition of 54.5 mol % of $Fe_2O_3$, 15 mol % of ZnO and 30.5 mol % of MnO, the mixture was subjected to CIP molding at 196 MPa for 180 seconds followed by baking at 1300° C. for 8 hours in a mixed gas of oxygen and nitrogen, thereby obtaining a baked body of the Mn—Zn ferrite with a mean grain size of 10 $\mu$m. A ring (outer diameter; 10 mm, inner diameter; 6 mm, thickness; 1.5 mm) for measuring core loss was sliced off from this baked body.

A transformer was assembled by the same method as in Example, except that this baked body was used.

Comparative Example 2

After adding an appropriate amount of an acrylic polymer as an organic binder into a starting powder material of Mn—Zn ferrite with a mean grain size of 1 $\mu$m obtained by a dry method and having a composition of 54.5 mol % of $Fe_2O_3$, a 6.5 mol % of ZnO and 39 mol % of MnO, the mixture was subjected to CIP molding at 196 MPa for 180 seconds followed by baking at 1200° C. for 4 hours in a mixed gas of oxygen and nitrogen, thereby obtaining a baked body of the Mn—Zn ferrite with a mean grain size of 5 $\mu$m. A ring (outer diameter; 10 mm, inner diameter; 6 mm, thickness; 1.5 mm) for measuring core loss was sliced off from this baked body.

A transformer was assembled by the same method as in Example except that this baked body was used.

The relation between the baking temperature and shrinkage ratio was measured with respect to the Mn—Zn ferrites obtained in Example, Comparative Example 1 and Comparative Example 2. The shrinkage ratio is obtained by measuring $\Delta L/L_0$ (%) wherein $L_0$ is the length of the baked body before baking and $\Delta L$ is the change of the length due to baking.

The shrinkage ratio of the baked body in Example increases as the baking temperature is increased, reaching to a stabilized area where the shrinkage ratio is stabilized at a temperature range from 1000 through 1200° C. This is because distribution of the mean grain size of the baked body in Example is small and all grains seem to be shrunk together as the baking temperature is increased.

Accordingly, the core for the inductive element produced from the baked body of the Mn—Zn ferrite in Example has a small mean grain size as well as small distribution of the grain size to increase the relative density of the baked body, suggesting that the core loss becomes small.

The shrinkage ratios of the baked bodies in Comparative Example 1 and 2 do not show, on the other hand, any remarkable increase in the shrinkage ratio as seen in Example exhibiting no stabilized area. Therefore, the baked bodies have a large mean grain size distribution along with a large core loss owing to small relative density.

The core loss was measured using sample rings for measuring the core loss obtained in Example and Comparative Example 1 and 2. A magnetization measuring apparatus (made by Ryowa Electronics Co. Ltd.,0375-2.1B) was used for measuring the core loss. The results of the measurements are shown in FIG. 17A and FIG. 17B.

Figure 17A:
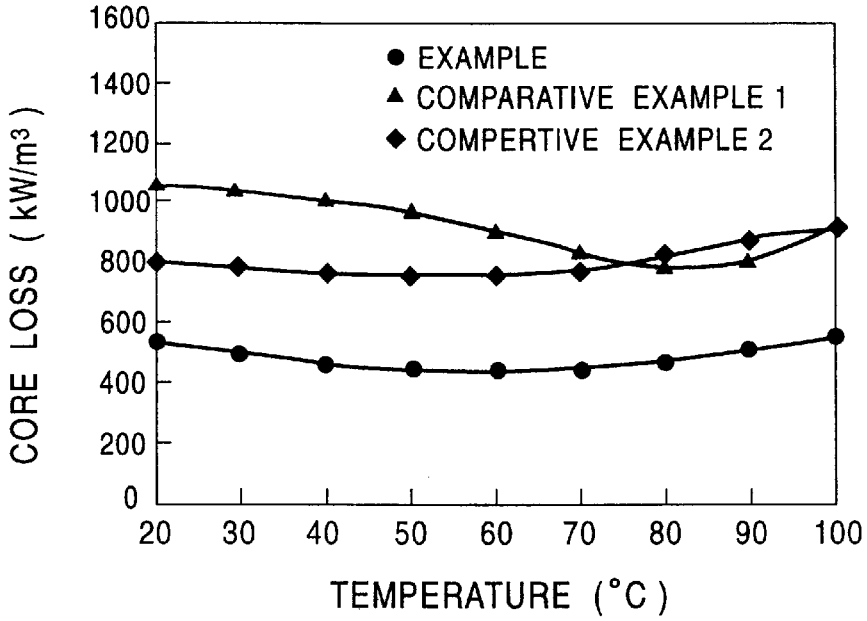
FIG. 17 is a graph for explaining the characteristics of the Mn—Zn ferrite according to the embodiment of the present invention, wherein A is a graph showing the relation between the retention temperature and core loss of the Mn—Zn ferrite and B is a graph showing the relation between frequencies and core loss of the Mn—Zn ferrite.

FIG. 17A shows the relation between the retention temperature of the Mn—Zn ferrite and core loss at a frequency of 1 MHz and a Bm value of 50 mT. It is evident that the Mn—Zn ferrite in Example has far more lower core loss value than the Mn—Zn ferrite in Comparative Example 1 and 2.

Figure 17B:
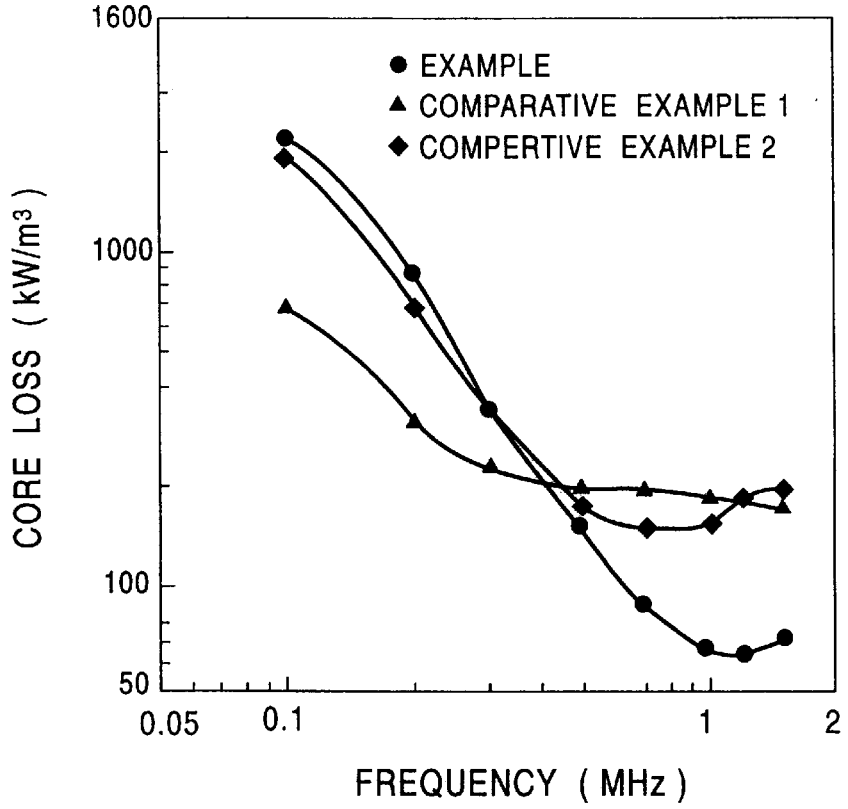

FIG. 17B shows the relation between the frequency of sign wave alternating current and core loss when Bm·f is 25 $\times 10^3$T·Hz and the setting temperature is 80° C. Although the Mn—Zn ferrite according to Example has a larger core loss at low frequency bands (0.1 to 0.3 MHz) than those in Comparative example 1 and 2, the core loss becomes smaller at a high frequency band (0.3 to 1.5 MHz), showing that the former ferrite is advantageous at a high frequency band.

Accordingly, it can be anticipated that characteristics at a high frequency band would be good when the inductive element is produced of the Mn—Zn ferrite according to Example.

Figure 18A:
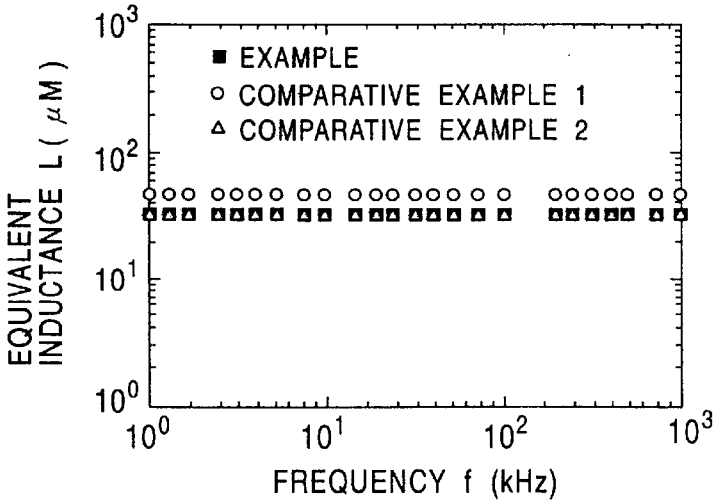
FIG. 18 is a graph for explaining the characteristics of the transformer provided with the core for the inductive element according to the embodiment of the present invention, wherein A is a graph showing the relation between the frequencies of the electric current flowing into the transformer and equivalent inductance, B is a graph showing the relation between the frequencies of the electric current flowing into the transformer and equivalent resistance and C is a graph showing the relation between the frequencies of the electric current flowing into the transformer and performance coefficient.

The characteristics of the transformers in Example and Comparative example 1 and 2 will be described hereinafter. FIG. 18 shows the equivalent resistance R and performance coefficient Q (=ωL/R) including the equivalent inductance, iron loss and core loss when a sign wave alternating current at a frequency region of $10^0$ to $10^3$ kHz is impressed while the secondary conductive member of the transformer remained. open. The measurement was carried out using an impedance analyzer.

Figure 18B:
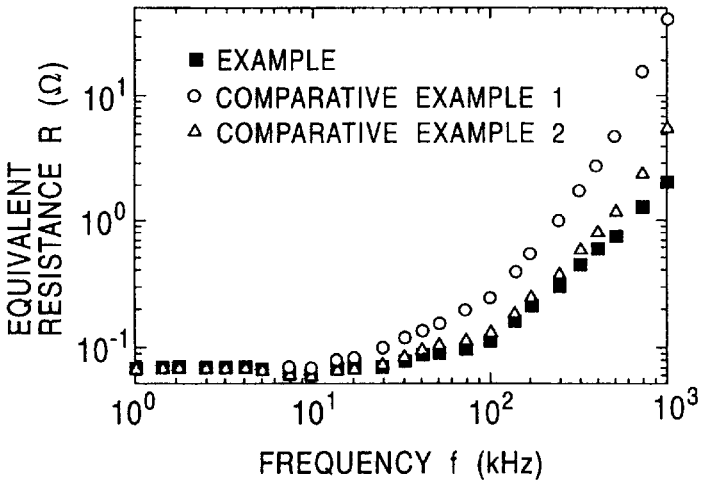

FIG. 18B shows that the transformer according to Example has a smaller equivalent resistance at a high frequency band of 10 kHz or more than the transformers in Comparative Example 1 and 2.

Figure 18C:
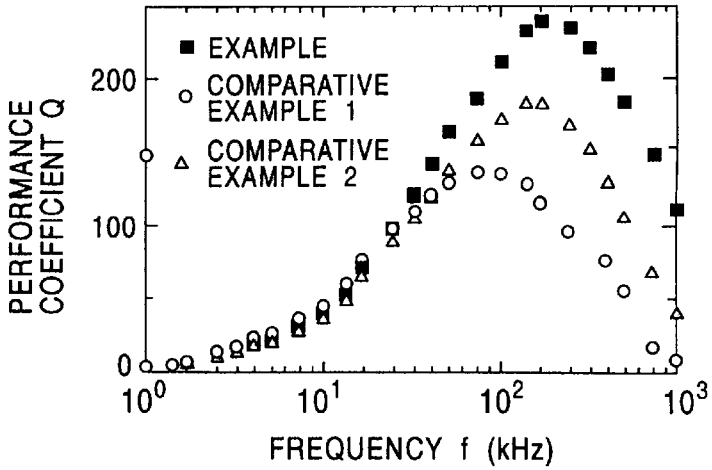

Although the transformer in Example exhibits a maximum performance coefficient of about 250 at a frequency around 0.2 MHz as shown in FIG. 18C, the frequency region where the performance coefficient shows a maximum value is as small as 0.09 to 0.1 MHz in the transformers in Comparative example 1 and 2 as compared with the transformer in Example, the performance coefficient itself of the latter being also as low a range as 120 to 160.

The transformer according to Example has an approximately equal equivalent inductance value to the transformers in Comparative example 1 and 2.

Figure 19:
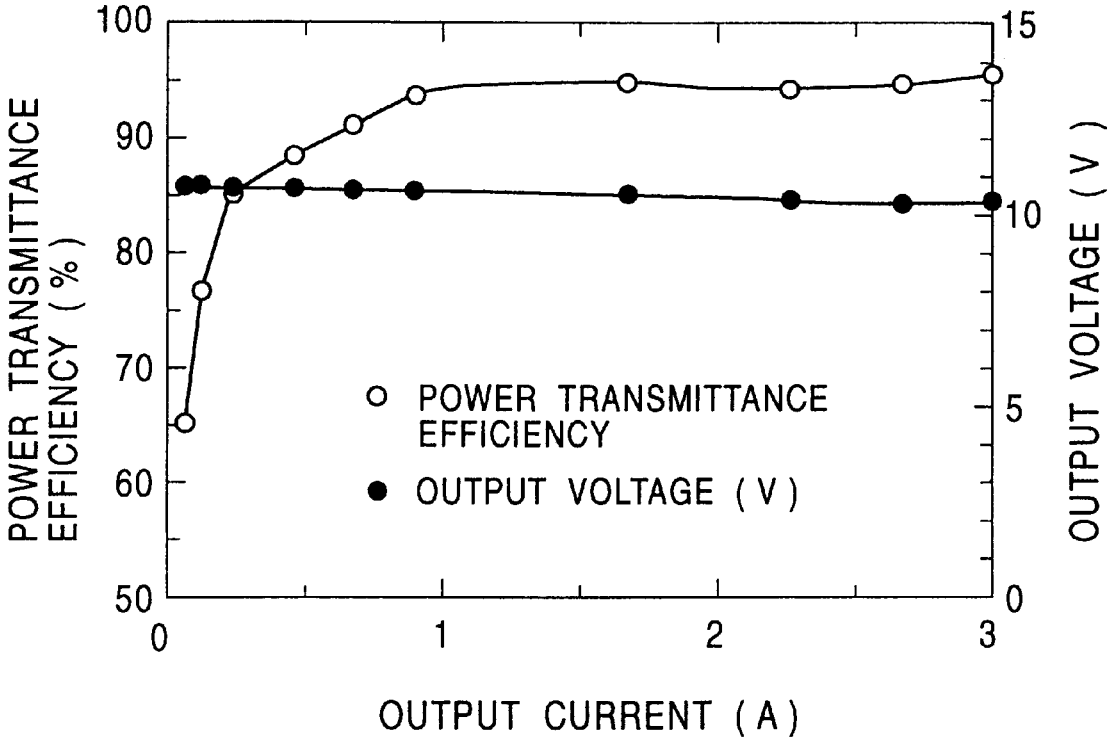
FIG. 19 is a graph showing power transmittance efficiency of the transformer provided with the core for the inductive element according to the embodiment of the present invention.
Figure 20A:
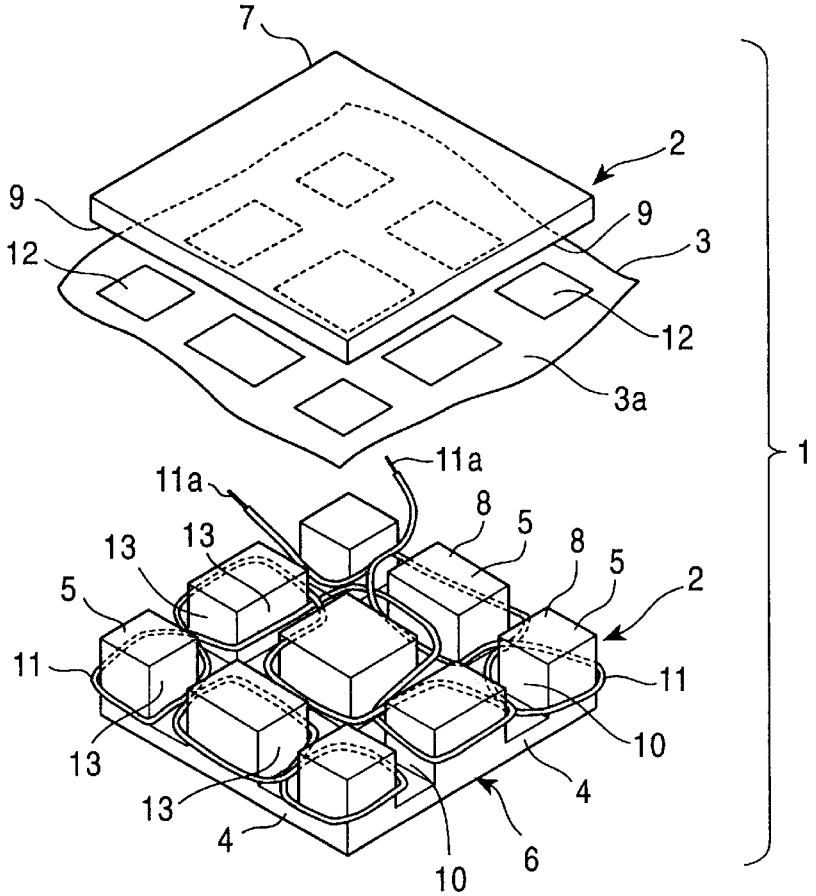
FIG. 20 is a drawing showing the inductor provided with the core for the conventional inductive element, wherein A is a disassembled perspective view and B is a plane view of the core for the inductive element.
Figure 20B:
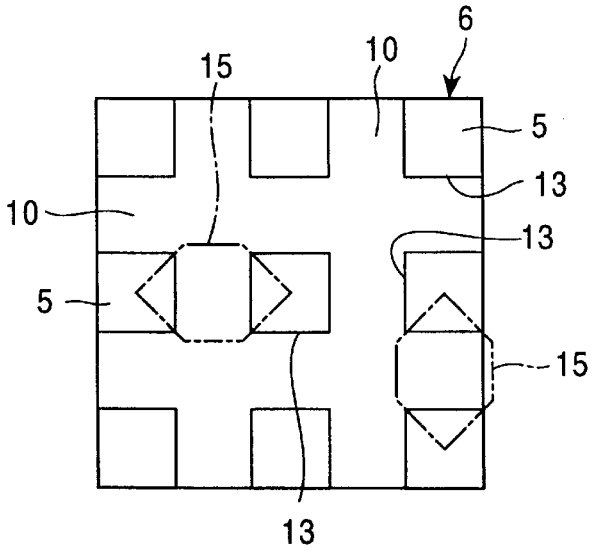

FIG. 19 shows the results of measurements of the power transmittance efficiency against the output voltage when a load resistance is connected to the terminal of the secondary coil of the transformer according to Example, wherein a sign wave alternating voltage (33 V) at a frequency of 500 kHz is impressed on the primary coil of the transformer while keeping the output voltage from the secondary coil to 10 V.

It can be understood from FIG. 19 that the power transmittance efficiency exceeds 90% when the output current is about 0.7 A, or when the output power is about 7 W, showing that the power transmittance efficiency increases as the output current has been increased.

Especially, a power transmittance efficiency of 95.2% is obtained when the output current is 3 A, or when the output power is 30 W.

As is evident from the foregoing discussions, the transformer according to Example displays a high power transmission efficiency despite its thin shape.

The results as hitherto described revealed that the transformer according to the present invention has a small core loss at a high frequency bad with good power transmittance efficiency despite its thin shape.

What is claimed is:

1. A core for an inductive element provided with a base core and a cover core made of a Mn—Zn ferrite with a mean grain size of 5 μm or less obtained by baking after molding a starting powder material of the Mn—Zn ferrite formed into grains, wherein a plurality of projections are aligned approximately in parallel relation with each other with a given distance apart among them on one face of at least one of said base core and said cover core, and said base core is overlaid with said cover via said projections, one or more of unit cores being formed of the base core, two or more of the projections and the cover core.

2. A core for the inductive element according to claim 1, wherein the ratio between the area S1 of one face of the base core or the cover core and the total area S2 of the top faces of the projections satisfies the relation of $1.1 \leqq S1/S2 \leqq 5.5$.

3. A core for the inductive element according to claim 1, wherein the Mn—Zn ferrite has the following composition represented by mol %:

$Fe_2O_3$: 52 to 55

ZnO: 5 to 20

MnO: 25 to 40.

4. A core for the inductive element according to claim 1, wherein the Mn—Zn ferrite has a relative density of 97% or more, a mean grain size of 1.3 to 3.0 μm and a performance coefficient of 50 to 300 at 1 MHz, the frequency range where a maximum performance coefficient is displayed being in the range from 0.2 through 2 MHz.

5. A transformer provided with a base core and a cover core made of a Mn—Zn ferrite with a mean grain size of 5 μm or less obtained by baking after molding the starting powder material of the Mn—Zn ferrite formed into grains, a plurality of projections being aligned approximately in parallel relation with each other with a given distance apart among them on one face of at least one of said base core and said cover core, and the base core being overlaid with the cover core via the projections, wherein said transformer is provided with:

the core for an inductive element in which one or more of unit cores are formed of the base core, two or more of the projections and the cover core;

a conductive plate for the transformer provided with an insulation plate through which holes for allowing said projections on said base core to penetrate are drilled; and a primary conductive member and a secondary conductive member formed on one face or on both faces of the insulation plate.

6. A transformer according to claim 5, wherein the conductive plate for the transformer is constituted by disposing the primary conductive member and the secondary conductive member forming a zigzag route along said holes, and the conductive plate for the transformer is disposed so as to be sandwiched between the base core and the cover core by allowing the projections to penetrate through the holes, the primary conductive member and the secondary conductive member being constituted so as to be disposed within the unit cores.

7. An inductor provided with a base core and a cover core made of a Mn—Zn ferrite with a mean grain size of 5 μm or less obtained by baking after molding the starting powder material of the Mn—Zn ferrite formed into grains, a plurality of projections being aligned approximately in parallel relation with each other with a given distance apart among them on one face of at least one of said base core and said cover core, and the base core being overlaid with the cover core via the projections, wherein said inductor is provided with:

the core for an inductive element in which one or more of unit cores are formed of the base core, two or more of the projections and the cover core;

a conductive plate for the inductor provided with an insulation plate through which holes for allowing said projections on said base core to penetrate are drilled; and a primary conductive member and a secondary conductive member formed on one face or on both faces of the insulation plate.

8. An inductor according to claim 7, wherein the conductive plate for said inductor are constituted by disposing said conductive members forming a zigzag route along said holes, and the conductive plate for the inductor is disposed so as to be sandwiched between the base core and the cover core by allowing the projections to penetrate through said holes, said conductive members being constituted so as to be disposed within the unit cores.

9. A core for an inductive element provided with a base core and a cover core made of a Mn—Zn ferrite with a mean grain size of 5 μm or less obtained by baking after molding the starting powder material of the Mn—Zn ferrite formed into grains, a projection group of a rectangle comprising a plurality of projections is aligned approximately in parallel relation with each other with a given distance apart among them on one face of at least one of said base core and said cover core, wherein the base core is overlaid with the cover core via said projections, one or more of unit cores being formed of the base core, two or more of the projections and the cover core.

10. A core for an inductive element according to claim 9, wherein the ratio between the area S1 of one face of the base core or the cover core and the total area S2 of the top faces of the projections satisfies the relation of $1.1 \leqq S1/S2 \leqq 5.5$.

11. A core for an inductive element according to claim 9, wherein the Mn—Zn ferrite has the following composition represented by mol %:

$Fe_2O_3$: 52 to 55

ZnO: 5 to 20

MnO: 25 to 40.

12. A core for an inductive element according to claim 9, wherein the Mn—Zn ferrite has a relative density of 97% or more, a mean grain size of 1.3 to 3.0 μm and a performance coefficient of 50 to 300 at 1 MHz, the frequency range where a maximum performance coefficient is displayed being from 0.2 through 2 MHz.

13. A transformer provided with a base core and a cover core made of a Mn—Zn ferrite with a mean grain size of 5 μm or less obtained by baking after molding the starting powder material of the Mn—Zn ferrite formed into grains, a projection group of a rectangle comprising a plurality of projections is aligned approximately in parallel relation with each other with a given distance apart among them on one face of at least one of said base core and said cover core, wherein the base core being overlaid with the cover core via a group of said projections, wherein said transformer is provided with:

the core for an inductive element in which one or more of the unit cores are formed of the base core, two or more of the projections and the cover core;

a conductive plate for the transformer provided with an insulation plate through which holes for allowing said projections on said base core to penetrate are drilled; and a primary conductive member and a secondary conductive member formed on one face or on both faces of the insulation plate.

14. A transformer according to claim 13, wherein the conductive plate for the transformer is constituted by disposing the primary conductive member and the secondary conductive member forming a zigzag route along the holes, and the conductive plate for the transformer is disposed so as to be sandwiched between the base core and cover core by allowing the projections to penetrate through the holes, the primary conductive member and the secondary conductive member being disposed within the unit cores.

15. An inductor provided with a base core and a cover core made of a Mn—Zn ferrite with a mean grain size of 5 μm or less obtained by baking after molding the starting powder material of the Mn—Zn ferrite formed into grains, a projection group of a rectangle comprising a plurality of projections is aligned approximately in parallel relation with each other with a given distance apart among them on one face of at least one of said base core and said cover core, wherein the base core being overlaid with the cover core via a group of said projections, wherein said inductor is provided with:

the core for an inductive element in which one or more of unit cores are formed of the base core, two or more of the projections and the cover core;

a conductive plate for the inductor provided with an insulation plate through which holes for allowing said projections on said base core to penetrate are drilled; and a primary conductive member and a secondary conductive member formed on one face or on both faces of the insulation plate.

16. An inductor according to claim 15, wherein the conductive plate for the inductor is constituted by disposing the conductive member forming a zigzag route along the holes, wherein the conductive plate for the inductor is disposed so as to be sandwiched between the base core and the cover core by allowing the projections to penetrate through the holes, the conductive member being constituted so as to be disposed within the unit cores.

17. A core for the inductive element constituted by being provided with a base core made of a Mn—Zn ferrite with a mean grain size of 5 μm or less obtained by baking after molding the starting powder material of the Mn—Zn ferrite formed into grains and being provided with a plate of a base part and two or more of pillar-shaped projections projecting out of one face of said base part, and a plate of a cover core, wherein the base core is integrated with the cover core by adhering the top faces of the pillar-shaped projections of the base core with the bottom face of the cover core, one or more of unit cores being formed of said base part, two or more of said pillar-shaped projections and said cover core.

18. A core for the inductive element according to claim 17, wherein the ratio between the area S1 of one face of the base core or the cover core and the total area S2 of the top faces of the projections satisfies the relation of $1.1 \leqq S1/S2 \leqq 16$.

19. A core for the inductive element according to claim 17, wherein the Mn—Zn ferrite has the following composition represented by mol %:

$Fe_2O_3$: 52 to 55

ZnO: 5 to 20

MnO: 25 to 40.

20. A core for the inductive element according to claim 17, wherein the Mn—Zn ferrite has a relative density of 97% or more, a mean grain size of 1.3 to 3.0 μm and a performance coefficient of 50 to 300 at 1 MHz, the frequency range where a maximum performance coefficient is displayed being from 0.2 through 2 MHz.

21. A transformer constituted by being provided with:

a core for an inductive element constituted by being provided with a base core, made of a Mn—Zn ferrite with a mean grain size of 5 μm or less obtained by baking after molding a starting powder material of the Mn—Zn ferrite formed into grains and being provided with a plate of a base part and two or more of pillar-shaped projections projecting out of one face of said base part, and a plate of a cover core, said base core being integrated with said cover core by adhering the top faces of the pillar-shaped projections of the base core with the bottom face of the cover core, wherein said transformer is provided with:

the core for the inductive element in which one or more of unit cores are formed of said base part, two or more of said pillar-shaped projected and said cover core;

a conductive plate for the transformer provided with an insulation plate through which holes for allowing the pillar-shaped projections to penetrate are drilled; and a primary conductive member and a secondary conductive member formed on one face or both the faces of said insulation plate.

22. A transformer according to claim 21, wherein the conductive plate for the transformer is constituted by disposing the primary conductive member and the secondary conductive member forming a zigzag route along the holes, the current flow direction of said secondary conductive member being disposed so as to cross with the current flow direction of the primary conductive member at a right angle, and the conductive plate for the transformer is disposed so as to be sandwiched between the base core and the cover core by allowing the pillar-shaped projections to penetrate through the holes, the primary conductive member and the secondary conductive member being disposed within the unit cores.

23. A transformer according to claim 21, wherein at least two or more of the secondary conductive members are formed on the conductive plate for the transformer.

24. An inductor constituted by being provided with a base core made of a Mn—zn ferrite with a mean grain size of 5 μm or less obtained by baking after molding a starting powder material of the Mn—Zn ferrite formed into grains and being provided with a plate of a base part and two or more of pillar-shaped projections projecting out of one face of said plate of the base part, and a plate of a cover core, the base core being integrated with the cover core by adhering the top faces of the pillar-shaped projections of the base core with the bottom face of the cover core, wherein said inductor is provided with a core for a inductive element in which at least one or more of unit cores are formed of said base plate, two or more of said pillar-shaped projections and said cover core;

an insulation plate through which holes for allowing the pillar-shaped projections of the base to penetrate are drilled; and a conductive plate for a inductor provided with the conductive member formed on one face or on both faces of said insulation layer.

25. An inductor according to claim 24, wherein the conductive plate for the inductor is constituted by disposing the conductive member forming a zigzag route along the holes, and the conductive plate for the inductor is disposed so as to be sandwiched between the base core and cover core by allowing the pillar-shaped projections to penetrate through the holes, the conductive member being disposed within the unit cores.

* * * * *

UNITED STATES PATENT AND TRADEMARK OFFICE

CERTIFICATE OF CORRECTION

PATENT NO. : 6,060,977
DATED : May 9, 2000
INVENTOR(S) : Yutaka Yamamoto et al.

It is certified that error appears in the above-identified patent and that said Letters Patent is hereby corrected as shown below:

Claim 17,
Line 1, change "the" to -- an --.

Claim 18,
Line 1, change "the" to -- an --.

Claim 19,
Line 1, change "the" to -- an --.

Claim 20,
Line 1, change "the" to -- an --.

Claim 24,
Line 2, change "Mn-zn" to -- Mn-Zn --.
Line 19, change "a inductor provided with the" to -- an inductor provided with a --.

Signed and Sealed this

Fourth Day of December, 2001

*Attest:*

Nicholas P. Godici

*Attesting Officer*

NICHOLAS P. GODICI
*Acting Director of the United States Patent and Trademark Office*